US008851439B2

(12) United States Patent
Phifer et al.

(10) Patent No.: US 8,851,439 B2
(45) **Date of Patent: *Oct. 7, 2014**

(54) READING STAND

(75) Inventors: Beverly C. Phifer, Tuscaloosa, AL (US); M. Scott Clark, Tuscaloosa, AL (US); Thomas G. Grammer, Northport, AL (US)

(73) Assignee: Phifer Incorporated, Tuscaloosa, AL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/405,794

(22) Filed: Feb. 27, 2012

(65) Prior Publication Data

US 2012/0152869 A1 Jun. 21, 2012

Related U.S. Application Data

(63) Continuation of application No. 11/117,693, filed on Apr. 29, 2005, now Pat. No. 8,123,189, which is a continuation-in-part of application No. 10/787,150, filed on Feb. 27, 2004, now Pat. No. 7,172,167.

(60) Provisional application No. 60/449,864, filed on Feb. 27, 2003.

(51) Int. Cl.
*A47B 97/04* (2006.01)
*A47B 23/04* (2006.01)

(52) U.S. Cl.
CPC ..... *A47B 23/044* (2013.01); *Y10S 190/901* (2013.01)
USPC ..... 248/460; 248/461; 108/6; 108/11; 190/30; 190/901; 150/143; 206/45.2; 312/245

(58) Field of Classification Search
USPC ..... 248/460, 461, 462, 463, 465, 454, 455, 248/451, 452, 453, 441.1, 447, 445, 456, 248/444, 447.1, 457, 371; 108/6, 9, 11, 14; 220/379, 744; 206/45.23, 454, 45.2; 190/30, 901; 150/143; 281/33, 45; 402/4, 73, 76; D19/88; 312/245
See application file for complete search history.

(56) References Cited

U.S. PATENT DOCUMENTS 43,575 A * 7/1864 Dimon ..... 248/452
264,995 A 9/1882 Armstrong, Jr.

(Continued)

FOREIGN PATENT DOCUMENTS

CN 2174093 Y 8/1994

OTHER PUBLICATIONS

International Search Report mailed Jan. 25, 2008, PCT/US06/16608.

(Continued)

*Primary Examiner* — Kimberly Wood
(74) *Attorney, Agent, or Firm* — Hunton & Williams LLP

(57) ABSTRACT

The invention provides a reading stand. The reading stand may comprising a base portion including at least one base portion sidewall, the base portion sidewall being supported by the base portion; and a platform portion forming a support surface to support the document, the platform portion including at least one page holder to retain the document. The reading stand may further include a side support clip extending from the platform portion such that the base portion sidewall is receivable between the platform portion and the side support clip in an assembled position, the side support clip having a protuberance disposed thereon, the protuberance engageable with the base portion sidewall. The assembled position affords side reading.

22 Claims, 26 Drawing Sheets

(56) References Cited

U.S. PATENT DOCUMENTS

| | | | | | |
|---|---|---|---|---|---|
| 352,654 | A | * | 11/1886 | Morton | 248/452 |
| 542,809 | A | * | 7/1895 | Reid | 248/453 |
| 582,140 | A | * | 5/1897 | Nolan | 248/452 |
| 590,175 | A | * | 9/1897 | Trussell | 24/67.7 |
| 793,978 | A | * | 7/1905 | Beidler | 248/446 |
| 993,761 | A | * | 5/1911 | Crane | 248/453 |
| 1,111,607 | A | * | 9/1914 | Nyberg | 248/451 |
| 1,203,659 | A | * | 11/1916 | Smith | 248/456 |
| 1,821,060 | A | * | 9/1931 | Isaacson | 248/455 |
| 1,876,681 | A | | 9/1932 | Irwin | |
| 1,919,835 | A | * | 7/1933 | Giese | 248/445 |
| 1,996,191 | A | | 4/1935 | Cook | |
| 2,003,746 | A | * | 6/1935 | Headington | 248/452 |
| 2,136,701 | A | | 11/1938 | Manierre | |
| 2,489,553 | A | * | 11/1949 | Wofford | 190/1 |
| 2,572,731 | A | | 10/1951 | Keith | |
| 2,595,682 | A | | 5/1952 | Lipa | |
| 2,627,694 | A | * | 2/1953 | Saecker | 248/447 |
| 3,202,471 | A | | 8/1965 | Wilson | |
| 3,381,928 | A | | 5/1968 | White | |
| 3,952,989 | A | * | 4/1976 | Bannister Hatcher | 248/453 |
| 4,014,508 | A | | 3/1977 | Weiss | |
| 4,015,813 | A | | 4/1977 | Graham | |
| 4,043,530 | A | * | 8/1977 | May | 248/453 |
| 4,163,539 | A | * | 8/1979 | Awofolu | 248/452 |
| 4,372,630 | A | | 2/1983 | Fuhri | |
| 4,380,947 | A | | 4/1983 | Nishimoto | |
| D269,188 | S | | 5/1983 | Tisdale | |
| 4,436,271 | A | * | 3/1984 | Manso | 248/460 |
| 4,471,933 | A | | 9/1984 | Nelson | |
| 4,863,124 | A | | 9/1989 | Ball et al. | |
| 4,896,252 | A | * | 1/1990 | Stewart | 362/98 |
| 4,948,139 | A | | 8/1990 | Heeszel | |
| 5,232,274 | A | | 8/1993 | Johan et al. | |
| 5,375,806 | A | | 12/1994 | Debus et al. | |
| 5,492,299 | A | | 2/1996 | Thermos | |
| 5,533,642 | A | | 7/1996 | Lafond et al. | |
| D373,600 | S | | 9/1996 | Oimas | |
| 5,577,628 | A | | 11/1996 | O'Neil et al. | |
| 5,607,135 | A | | 3/1997 | Yamada | |
| 5,651,525 | A | * | 7/1997 | Yang | 248/456 |
| 5,692,815 | A | | 12/1997 | Murphy | |
| 5,765,799 | A | | 6/1998 | Weber | |
| 5,797,578 | A | * | 8/1998 | Graffeo et al. | 248/453 |
| 5,823,500 | A | | 10/1998 | La Coste | |
| 5,855,329 | A | * | 1/1999 | Pagano | 248/451 |
| 5,855,351 | A | * | 1/1999 | Cziraky et al. | 248/451 |
| 5,884,889 | A | | 3/1999 | Crosby | |
| 5,893,546 | A | | 4/1999 | Renfroe | |
| 5,944,209 | A | | 8/1999 | Daoud | |
| 6,000,663 | A | | 12/1999 | Plasse et al. | |
| 6,003,446 | A | | 12/1999 | Leibowitz | |
| 6,038,983 | A | * | 3/2000 | Lendl | 108/44 |
| 6,045,108 | A | | 4/2000 | Cziraky | |
| 6,085,917 | A | * | 7/2000 | Odom | 211/119.003 |
| 6,109,658 | A | * | 8/2000 | Moore | 281/42 |
| 6,134,103 | A | | 10/2000 | Ghanma | |
| 6,302,273 | B1 | | 10/2001 | Edmunds | |
| 6,311,944 | B1 | | 11/2001 | McKsymick et al. | |
| 6,353,529 | B1 | | 3/2002 | Cies | |
| 6,497,391 | B1 | | 12/2002 | Timm | |
| 6,540,192 | B2 | * | 4/2003 | Ouellet | 248/461 |
| 6,682,038 | B2 | | 1/2004 | Golynsky | |
| 6,749,228 | B2 | * | 6/2004 | Takemura | 281/33 |
| 6,751,878 | B2 | | 6/2004 | Hamann | |
| 6,971,622 | B2 | | 12/2005 | Ziegler et al. | |
| D514,057 | S | | 1/2006 | Borunda et al. | |
| 7,121,214 | B1 | | 10/2006 | Toltzman et al. | |
| 7,172,167 | B2 | * | 2/2007 | Phifer et al. | 248/460 |
| 7,293,751 | B2 | | 11/2007 | Eriksson | |
| 7,770,864 | B2 | | 8/2010 | Phifer et al. | |
| 7,959,124 | B2 | * | 6/2011 | Phifer et al. | 248/451 |
| 8,123,189 | B2 | * | 2/2012 | Phifer et al. | 248/460 |
| 2002/0044819 | A1 | * | 4/2002 | Shamoon | 402/73 |
| 2003/0010884 | A1 | | 1/2003 | Jones | |
| 2003/0029985 | A1 | * | 2/2003 | Zeller et al. | 248/461 |
| 2004/0256534 | A1 | | 12/2004 | Phifer et al. | |
| 2005/0098703 | A1 | | 5/2005 | Cziraky | |
| 2005/0121594 | A1 | | 6/2005 | Kuo | |
| 2005/0285009 | A1 | | 12/2005 | Phifer et al. | |
| 2006/0108494 | A1 | | 5/2006 | Lancet | |
| 2006/0124822 | A1 | | 6/2006 | Munda et al. | |
| 2007/0221811 | A1 | | 9/2007 | Hauser et al. | |
| 2009/0179124 | A1 | | 7/2009 | Caplan | |
| 2009/0321605 | A1 | | 12/2009 | Petrie | |
| 2010/0006735 | A1 | | 1/2010 | Reinen | |

OTHER PUBLICATIONS

International Search Report mailed Aug. 29, 2005, PCT/US04/05705.

European Search Report dated Mar. 9, 2006, EP 04 71 5625.

International Search Report dated Aug. 9, 2007, PCT/US06/03005.

International Search Report dated Apr. 27, 2011, PCT/US011/27182.

"You can do it Bindependent We can Help, Adapt-A-Lab book Holder", Adapt-A-Lap book Holder, 4 pages from www.bindependent.com.

"Bodyguard, Nellie's Exercise Equipment . . . ," 1 page from nellis.com.

"Large and Small Paperbacks Stay . . . ", 1 page from store3.yimg.com.

"Relieve Neck and Back Pain, Improve your reading Immediately with Our Adjustable Book Holders", 4 pages from www.proportionalreading.com.

"AtlasTM Ergonomic Book & Copy Holders", 1 page from www.bookandcopyholders.com.

"Book Holders", 1 page from sfpl.lib.ca.us.

"You can do it Bindependent We can Help, Two-Piece Tiliting Table", 2 pages from www.bindependent.com.

"MyPlace Pro Workstation," www.asseenontv.com/prod-pages/my_pic_ontv.html, date unknown.

"Porta-Book," www.portabooktv.com/Default.asp?bhcp=1, date unknown.

* cited by examiner

On-side bed reading position

READING STAND

This application is a continuation of U.S. patent application Ser. No. 11/117,693 filed Apr. 29, 2005 now U.S. Pat. No. 8,123,189, which is a continuation-in-part (CIP) application of U.S. patent application Ser. No. 10/787,150 filed Feb. 27, 2004 now U.S. Pat. No. 7,172,167, which claims priority to U.S. Provisional Application No. 60/449,864 filed Feb. 27, 2003, all of which are incorporated herein by reference in their entirety.

BACKGROUND OF THE INVENTION

The invention relates to devices to support a book or other reading material item or items.

Various devices have been used in the past to support a book, or other reading material item, such that the book may be easily supported and in a position to easily view the contents of the book. However, known devices for supporting a reading material item have various deficiencies. Some known devices are difficult to hold for extended periods of time, as is often desired when reading. Further, while other devices may be easy to hold in general, they do not support the reading material in such a manner so that it is easy to turn the pages of the reading material. Further, known devices are not readily adaptable to afford reading on one's side. Other problems exist with known devices.

BRIEF SUMMARY OF THE INVENTION

The invention provides a reading stand. The reading stand may comprising a base portion including at least one base portion sidewall, the base portion sidewall being supported by the base portion; and a platform portion forming a support surface to support the document, the platform portion including at least one page holder to retain the document. The reading stand may further include a side support clip extending from the platform portion such that the base portion sidewall is receivable between the platform portion and the side support clip in an assembled position. The side support clip may include a protuberance disposed thereon, the protuberance engageable with the base portion sidewall. The side support clip may be provided with a retaining shoulder. The assembled position affords side reading.

BRIEF DESCRIPTION OF THE DRAWINGS

The present invention can be more fully understood by reading the following detailed description together with the accompanying drawings, in which like reference indicators are used to designate like elements, and in which.

DETAILED DESCRIPTION OF THE INVENTION

Hereinafter, aspects of the invention in accordance with various embodiments will be described. As used herein, any term in the singular may be interpreted to be in the plural, and alternatively, any term in the plural may be interpreted to be in the singular.

The inventive device is used to hold books, or other reading items, open so that the book may be read without holding it in the reader's hands, in accordance with one aspect of the invention. In accordance with one embodiment of the invention as described below, an arrangement is provided with a support surface, along with clamps or arms, that hold the opposite pages of a book, for example, open in a fashion so that the book can be read without physically holding the pages of the book. For example, the reading stand may be used while exercising. In accordance with another use of the invention, the reading stand of the invention may be stood on either end so that a person may read while lying in bed or on his side or her side.

FIGS. 1-6 are various perspective views showing a reading stand 10 in accordance with one embodiment of the invention. As shown, the reading stand 10 includes a base 100 and a reading lid 200. Together, the base 100 and the reading lid 200 provide a versatile document support.

Figure 2:
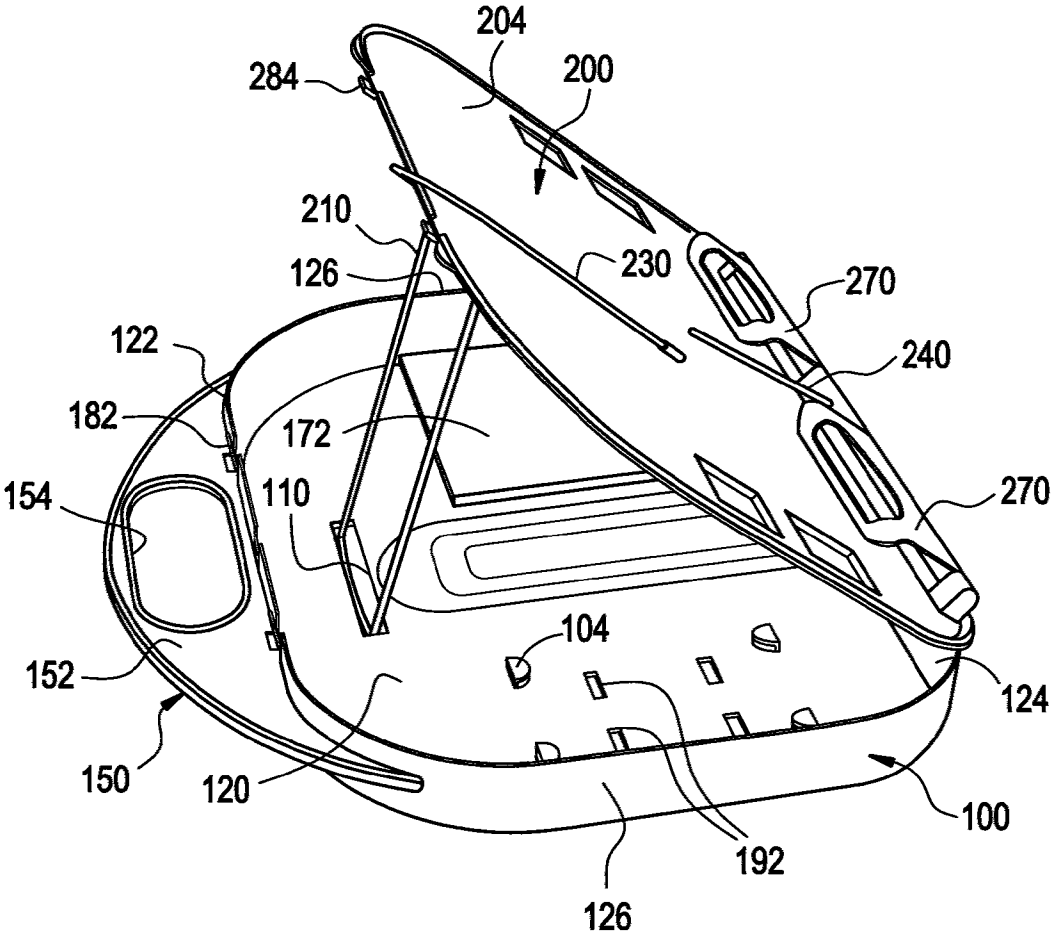
FIG. 2 is a back perspective view of the reading stand of FIG. 1 for supporting a book in accordance with one embodiment of the invention.

The base 100 includes a base member case 101 that forms a case that may be used to hold papers, writing instruments, recipes or other items, as may be desired. In particular, the base member case 101 includes a base panel, along with a base front wall 122, a base back wall 124 and two base side walls 126, as shown in FIG. 2. The walls are connected to the base panel to form an enclosed volume, i.e., with the reading lid 200 positionable to be a lid for the enclosed volume.

Figure 1:
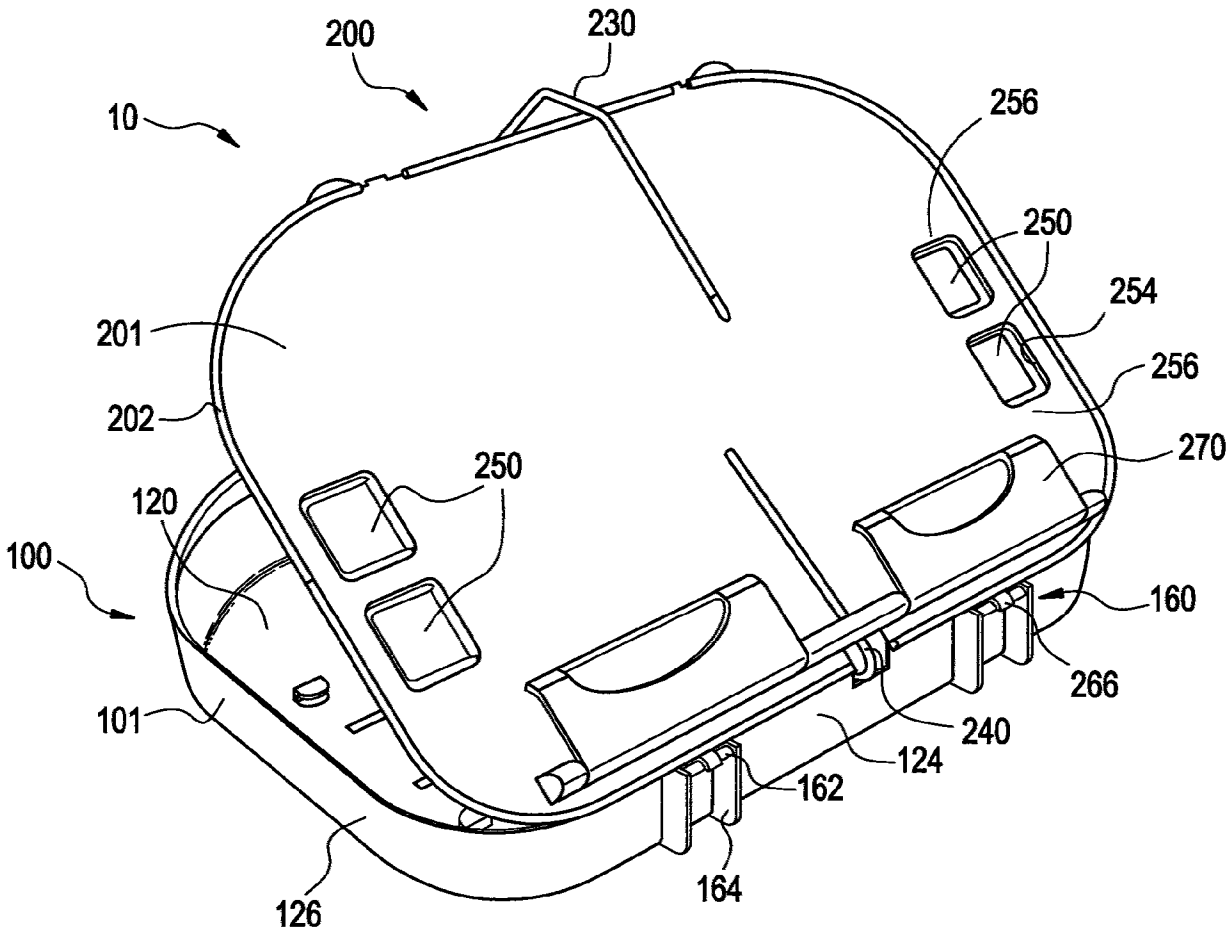
FIG. 1 is a front perspective view of a reading stand for supporting a book in accordance with one embodiment of the invention.

In accordance with one embodiment of the invention, the reading lid 200 may include a reading platform 201 having a reading platform backside 203 and a reading platform front side 204. Further, as shown in FIG. 1, the reading lid 200 includes two page holders 270. The page holders 270 may be spring biased, for example, so as to assist in retaining a document upon the reading lid front side 204.

Figure 3:
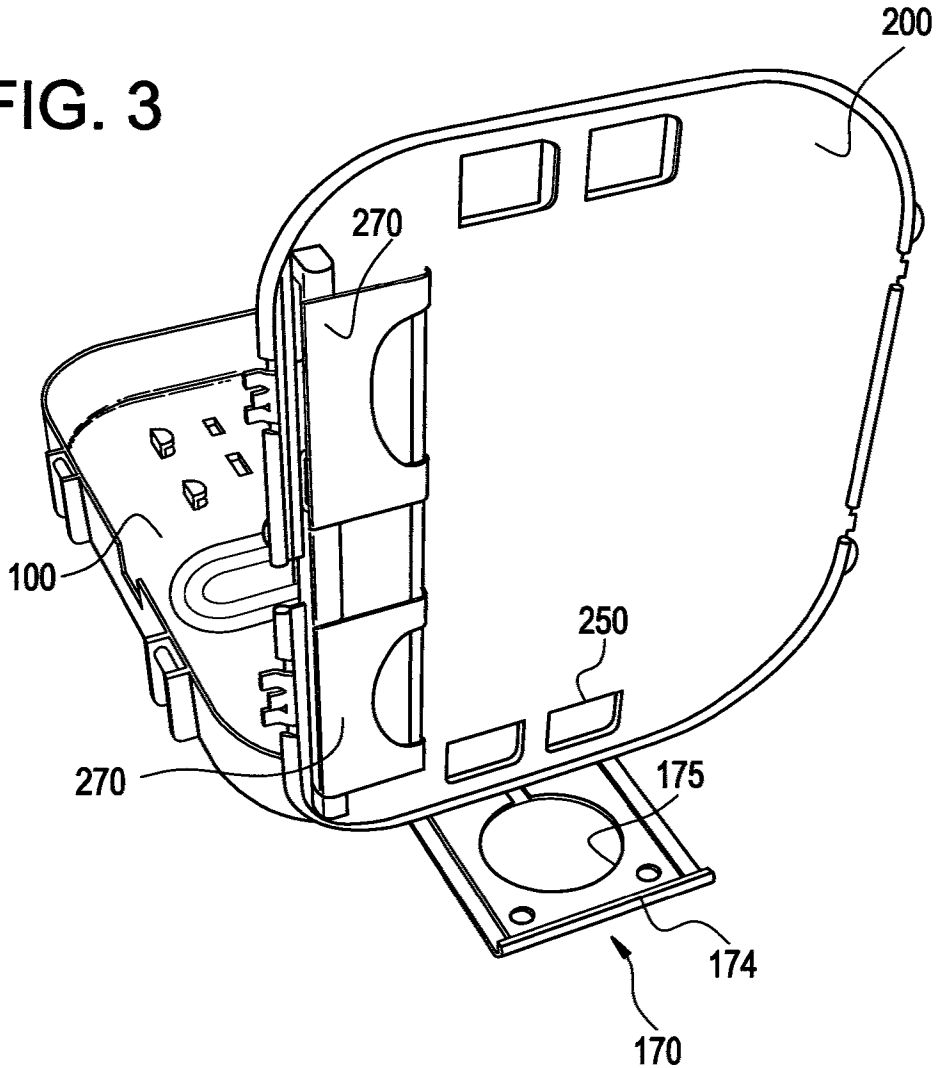
FIG. 3 is a front perspective view of a reading stand of FIG. 1 for supporting a book, in an alternative arrangement for side reading, in accordance with one embodiment of the invention.

Further, the reading lid 200 includes a support member. The support member extends from the reading platform backside 203. The support member is adapted to engage with the base member case 101 so as to support the reading lid. To explain, the support member may be in the form of two structures. For example, the support member may be in the form of a prop member 210. Further, in accordance with one embodiment of the invention, a support member may also be provided in the form of a side support clip 250. The prop member 210 may be utilized to support the reading platform 201 so as to afford reading a document in a substantially vertical orientation. Alternatively, the side support clip 250 or clips afford reading a document in a side position, as shown in FIG. 3. As shown in FIG. 1, in accordance with one embodiment of the invention, the reading stand 10 is provided with both the prop member 210 and the side support clips 250.

Figure 4:
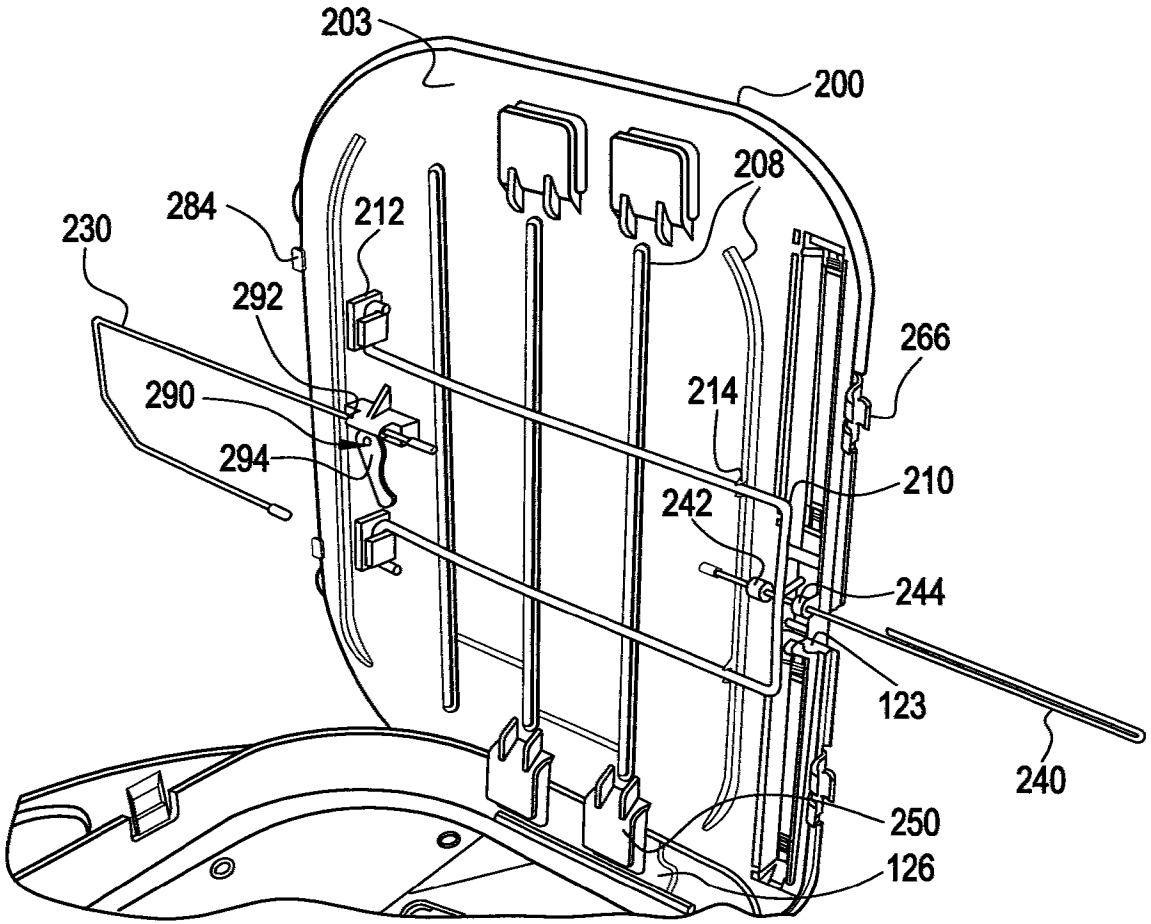
FIG. 4 is a back perspective view of the reading stand of FIG. 3, in an alternative arrangement for side reading, in accordance with one embodiment of the invention.

In further explanation of the prop member 210, FIGS. 2 and 4 show further views of the reading stand 10 of FIG. 1. As shown in FIG. 4 in particular, the prop member 210 may be pivotally connected to the backside 203 of the reading platform by a pair of support member hinges 212. The prop member 210 is engageable with the base member case 101 so as to support the reading platform in a variety of positions. For example, the prop member 210 may be in the form of a wire shaped into a u-shape. However, it should be appreciated that other arrangements, e.g., such as a plastic structure, might be used in lieu of the wire arrangement.

In accordance with one embodiment of the invention, the base panel 120 may be provided with a prop slot 110. The prop member 210 is extendable through the prop slot 110 to extend exterior to the base member case so as to provide a hanger for the reading stand. For example, the prop member 210 may extend through the prop slot 110 to provide a hanger for securing the reading stand on a treadmill structure, in accordance with one favored use of invention. As should be appreciated, in this arrangement with the prop member extending through the prop slot to extend exterior to the base member case, the reading lid is typically disposed upon the base member case in a closed position, i.e., the reading platform 201 rests upon the walls (122, 124, 126) of the base member case 101.

However, in an alternative arrangement, the prop member 210 does not pass through the prop slot 110 (so as to provide a hanger for the reading stand 10), but rather, the prop member 210 is positioned so as to rest upon the lower panel of the base member case 101, i.e., so as to rest upon the base panel 120, as shown in FIGS. 1 and 2. The prop member may be positioned to support the reading platform at a variety of angles relative to the base panel. For example, the reading platform may be disposed between approximately 20 degrees and 70 degrees relative to the base panel. Such angle depends on the particular location that the prop member 210 rests on the base panel 120. Relatedly, the base panel 120 might be provided with raised ribs, for example, so as to prevent the prop member 210 from sliding from a desired position. Also, the prop member 210 might be disposed on the prop slot 110 as shown in FIG. 2, i.e., so as to rest upon the same surface that the base member case 101 rests upon.

Hereinafter, further aspects of the reading lid 200 will be described. The reading lid 200 may include a page assist support 230, as shown in FIGS. 1, 2 and 4, for example. In accordance with one embodiment of the invention, the page assist support 230 may be in the form of a u-shaped wire. The page assist support 230, as shown in FIG. 4, is attached to the reading platform backside 203 using a page assist lock 290. The page assist lock 290 comprises a cam collar 292 and a cam lever 294, in accordance with one embodiment of the invention. However, other locking mechanisms might be utilized instead. While not in use, the page assist support 230 may be stowed behind the reading platform 201. Then, when a reader desires to use the page assist support 230, the user manipulates the page assist support 230 so that a portion of the page assist support 230 is positioned in front of the reading platform 201, as shown in FIG. 1, for example.

Once the page assist support 230 is positioned in a desired position, the cam lever 294 may be rotated so as to frictionally bind the page assist support 230 within the cam collar 292, i.e., so as to hold the page assist support 230 in the desired position. That is, the cam lever 294 is provided with an eccentric cam surface so as to variably apply pressure on the page assist support 230 depending on the rotational position of the cam lever 294.

Figure 7:
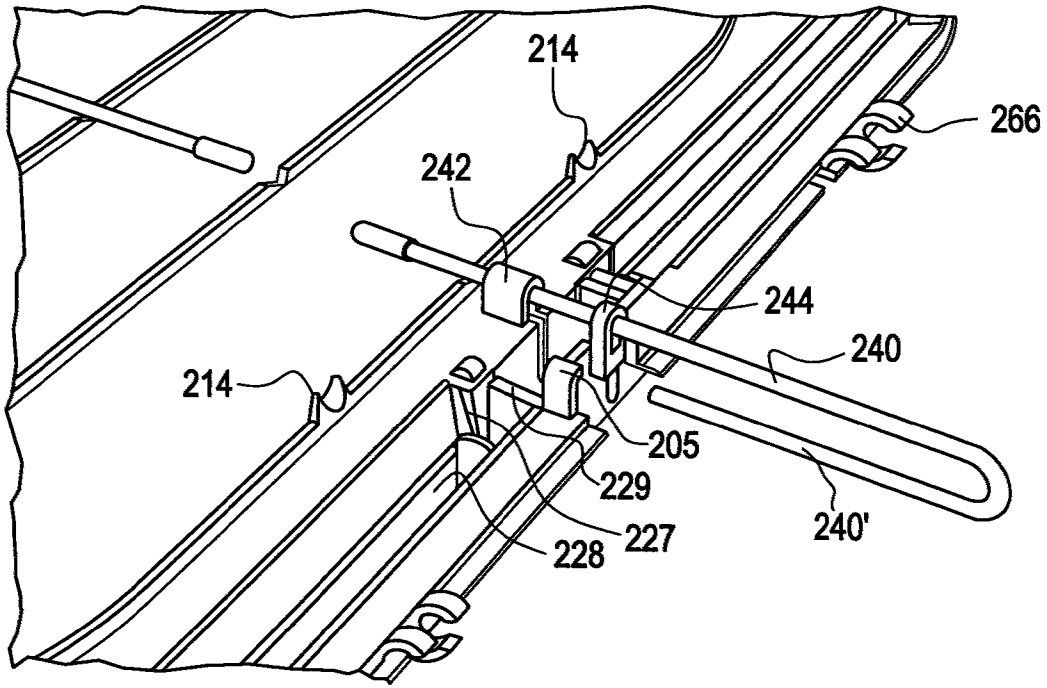
FIG. 7 is a perspective view showing further details of the reading lid underside of the reading stand of FIG. 1 in accordance with one embodiment of the invention.
Figure 11:
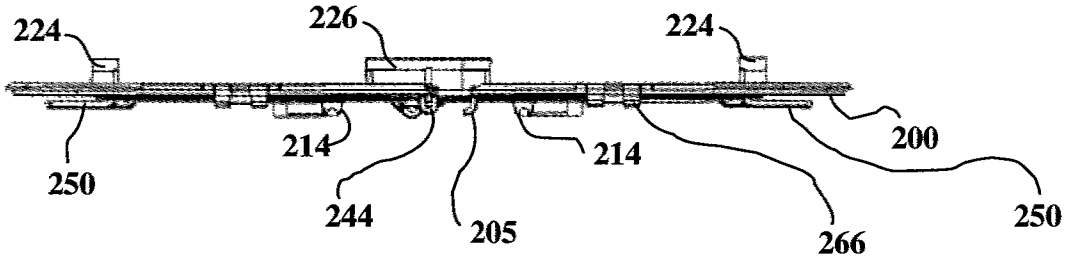
FIG. 11 is a side view of the reading lid of FIG. 9 in accordance with one embodiment of the invention.

The reading lid 200 may further be provided with a center document support 240 in accordance with one embodiment of the invention. The center document support 240 may also be in the shape of a u-shaped wire, as shown in FIGS. 1, 2 and 4, as well as FIG. 7. As shown, the center document support 240 is attached to the reading platform backside 203 using a primary collar 242 and a bracing collar 244. That is, the center document support 240 is slidably positioned within respective apertures in the primary collar 242 and a bracing collar 244. As shown in FIGS. 7 and 11, the reading lid 200 may also include a center document support retainer 205. The center document support retainer 205 serves to secure the center document support 240 while the center document support 240 is not in use, i.e., when the center document support 240 is stowed behind the reading lid 200 while the reading lid 200 is in a closed position, for example.

Figure 12:
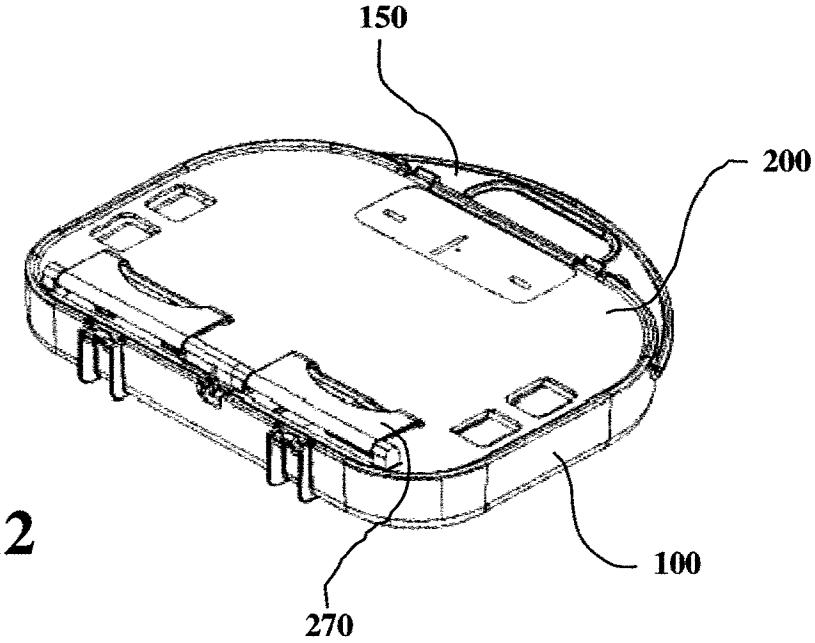
FIG. 12 is a front perspective view of a reading stand in a closed position with the base of FIG. 8 and the lid of FIG. 9 in accordance with one embodiment of the invention.

In accordance with one aspect of the invention, the reading lid 200 may further include a set of prop retainers 214 that are integrally formed with the reading platform 201, as shown in FIG. 4 and FIG. 12, for example. The prop retainers 214 serve to secure the prop member 210 when the prop member 210 is not in use.

Figure 10:
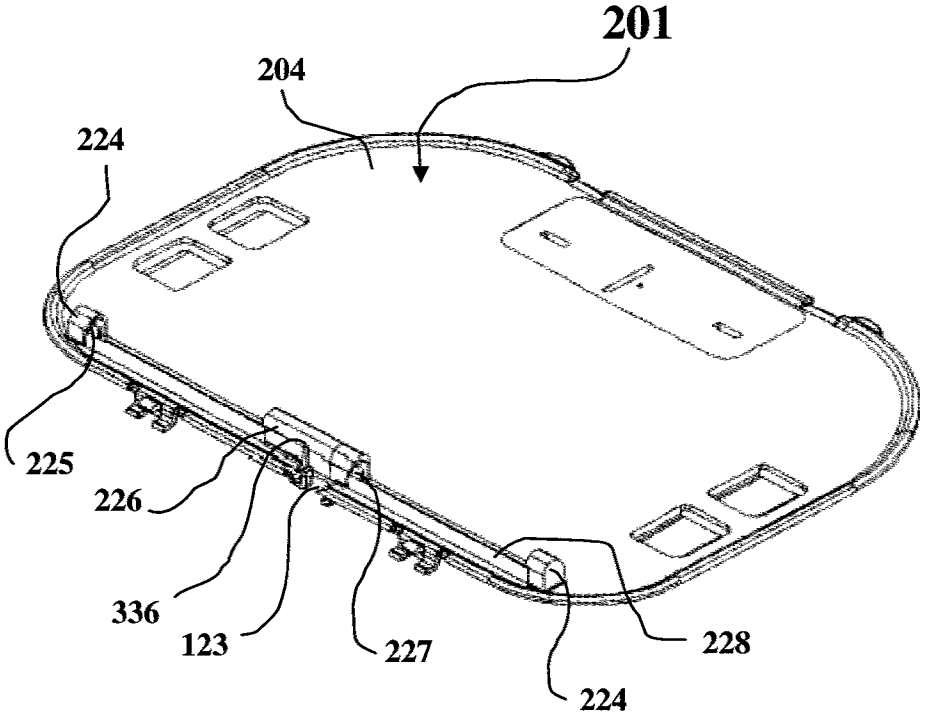
FIG. 10 is a perspective view of the reading lid of FIG. 9 in accordance with one embodiment of the invention.

As described herein, the reading lid 200 is disposed upon the base 100. In accordance with one aspect and arrangement of the invention, the reading lid 200 is supported using the prop member 210. In this arrangement, the reading lid 200 is disposed upon the base 100 using a hinge assembly 160, as shown in FIG. 1, for example. The hinge assembly 160 includes a hinge shoulder portion 266 that is integrally formed with the reading platform 201 in accordance with one embodiment of the invention. The hinge shoulder portion 266 may include a set of opposing fingers as shown in FIGS. 4 and 10, for example.

The hinge shoulder portion 266 interfaces with a pin 162 that is integrally formed with the base 100. That is, the hinge shoulder portion 266 interfaces with the pin 162 so as to provide the hinge 160, which is easily disconnectable. The pin 162 is attached to the base 100 between a flange pair 164, as shown in FIG. 1.

FIG. 3 is a front perspective view of a reading stand of FIG. 1 for supporting a book, in the alternative arrangement for side reading as discussed above, in accordance with one embodiment of the invention. As shown in FIG. 3, the reading stand 10 affords comfortable on side "hands free" reading in bed, for example. As shown, the reading lid 200 is disposed on a base side wall 126 of the base member case 101 using the side support clips 250. As should be appreciated, in such arrangement, the reading stand 10 might be prone to tipping over to the side upon which the reading lid 200 is positioned upon the base 100. In order to prevent such tipping, the reading stand 10 includes a side reading brace assembly 170.

The side reading brace assembly 170 includes a tray housing 172 and a side support tray 174. The side support tray 174 is adjustably positionable between a stowed position in which the side support tray 174 is disposed in the tray housing 172 in the base member case, and an extended position in which the side support tray 174 extends out from the base member case 101, such that the side support tray 174 prevents the reading stand 10 from tipping. The tray housing 172 in which the side support tray 174 is housed (in the stowed position) is shown from the interior in FIG. 2.

As shown in FIG. 3, the reading lid 200 may be supported by the side support clips 250 so as to be in a substantially vertical position, i.e., "substantially vertically" meaning having a sufficient vertical orientation so as to allow reading of a document disposed upon the reading lid 200.

Figure 6:
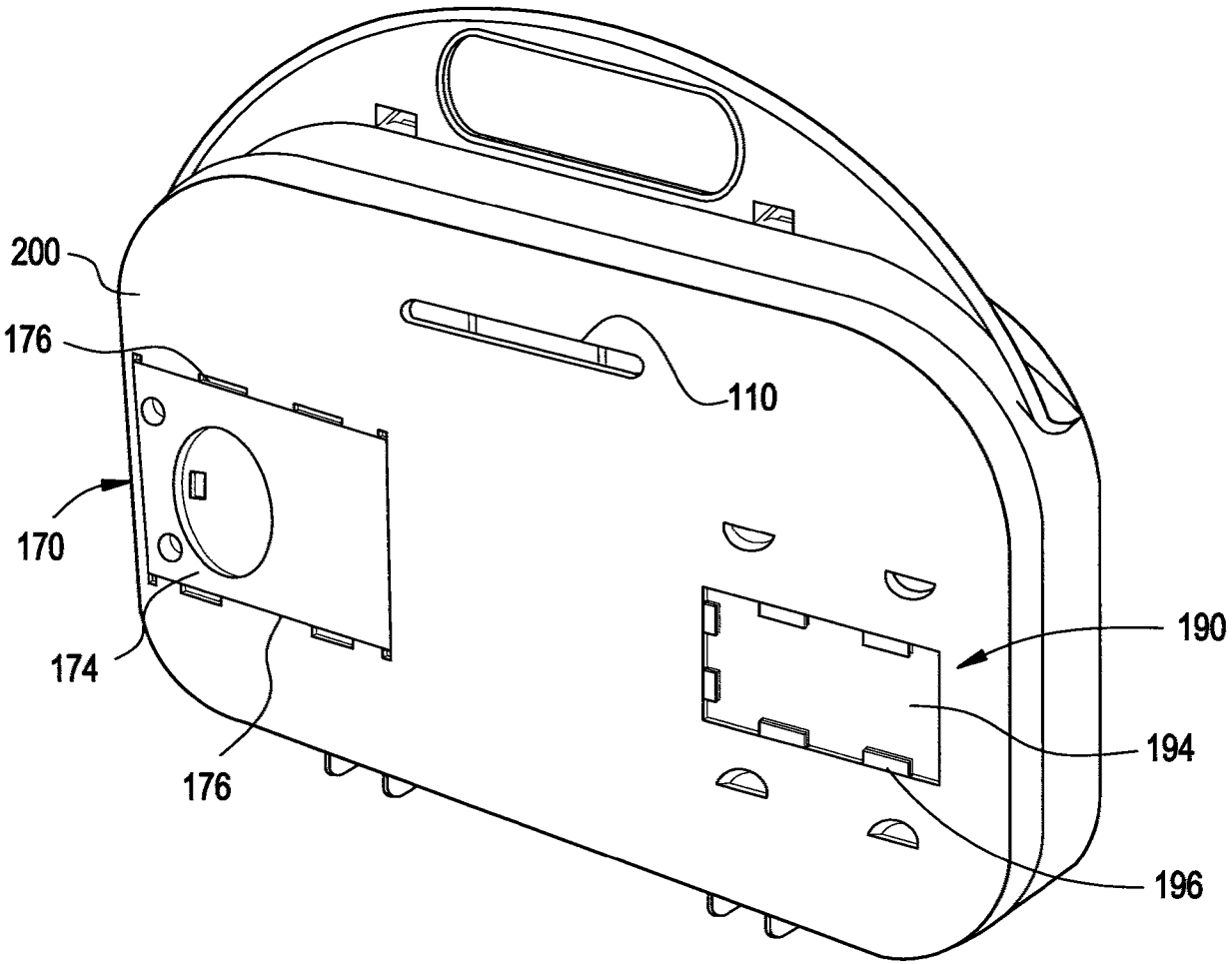
FIG. 6 is a back perspective view of the reading stand of FIG. 1 in a closed and upright position in accordance with one embodiment of the invention.
Figure 13:
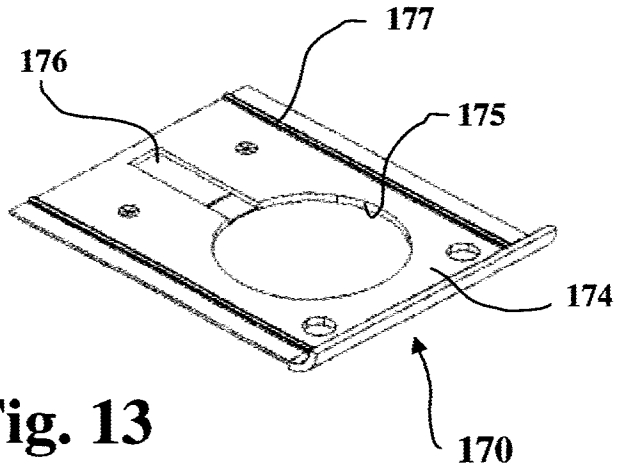
FIG. 13 is a perspective view showing further details of a side support tray in accordance with one embodiment of the invention.

FIG. 13 is provided to show the side support tray 174 in further detail. A cup aperture 175 may be disposed in the side support tray 174. Also, FIG. 6 is a back perspective view of the reading stand of FIG. 1 in a closed and upright position showing further aspects of the side reading brace assembly 170, in accordance with one embodiment of the invention. That is, as shown, the tray housing 172 may form a brace channel 176 in which the side support tray 174 is disposed in the stowed position.

FIG. 6 also shows another feature of the reading stand 10 in accordance with one embodiment of the invention. As shown, the base 100 may be provided with a cardholder 190. The cardholder 190 may comprise a recessed panel 194 in conjunction with retaining flanges 192, as also shown in FIG. 2. The cardholder 190 affords retainment of a business card, for example.

Further, the base panel 120 may be provided with four instruction booklet retainers 104, i.e., flanges 104. The instruction booklet retainers 104 serve to provide an instruction booklet holder, which may be provided to a purchaser of the reading stand 10 explaining use of the reading stand 10.

As shown in FIG. 2, the reading stand 10 may further include a handle 150. The handle 150 includes a handle flange 152 and a handle aperture 154, in accordance with one embodiment of the invention. The handle flange 152 and the handle aperture 154 afford easy carrying of the reading stand 10.

Figure 5:
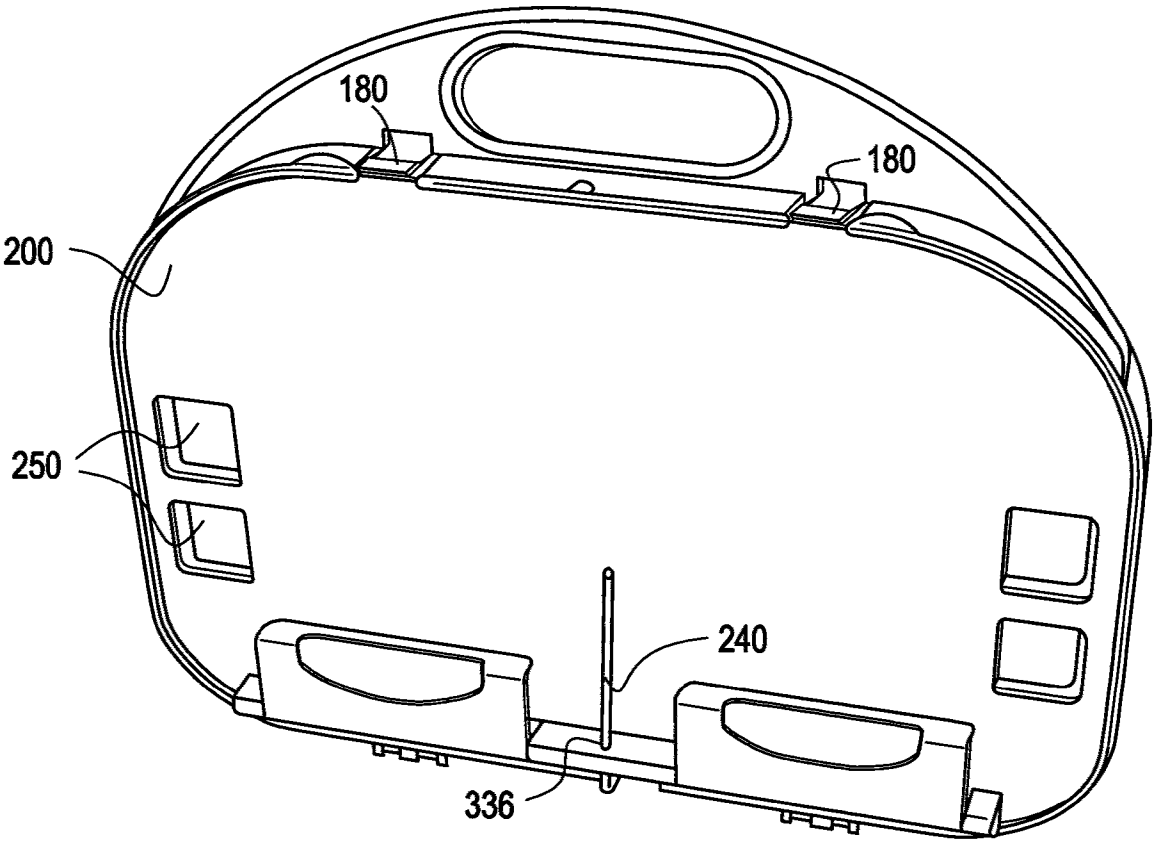
FIG. 5 is a front perspective view of the reading stand of FIG. 1 in a closed and upright position in accordance with one embodiment of the invention.
Figure 8:
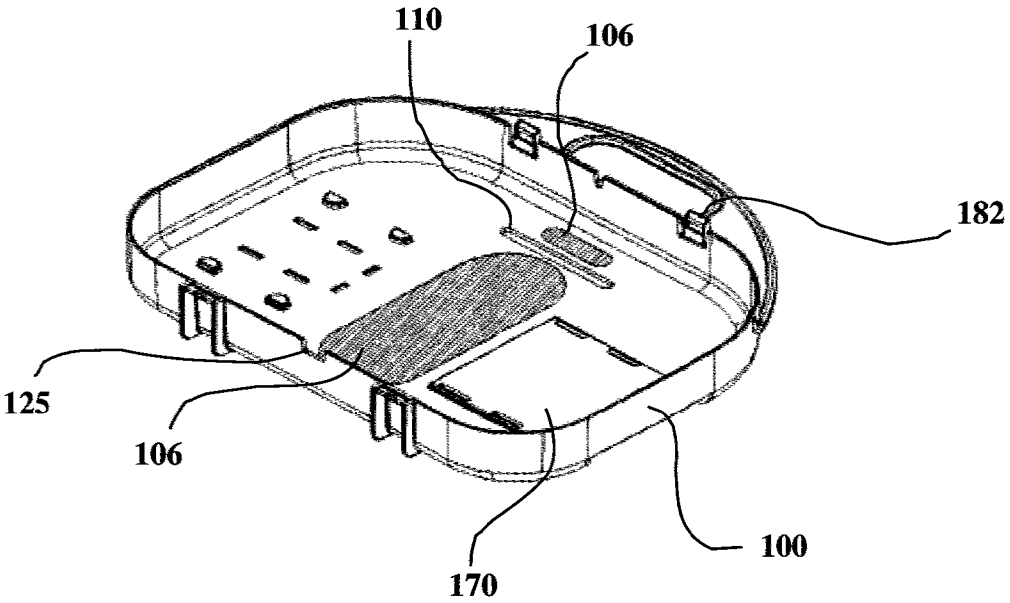
FIG. 8 is a front perspective view of the base member case of a reading stand in accordance with one embodiment of the invention.

As shown in FIGS. 2, 8 and 12, for example, a latch shoulder 284 may be provided in conjunction with a latch arm 182 to collectively provide a latch to secure the reading lid 200 upon the base 100 in a closed position. That is, the latch shoulder 284 is integrally formed with the reading platform 201 and the latch arm 182 is integrally formed with the base member case 101 in accordance with one embodiment of the invention. Accordingly, the latch (182, 284) may used to secure the base member case 101 to the reading platform 201 for carrying or storage of items within the reading stand 10, for example. Relatedly, FIG. 5 is a front perspective view of the reading stand of FIG. 1 in a closed and upright position in accordance with one embodiment of the invention. Further, FIG. 6 is a back perspective view of the reading stand of FIG. 1 in a closed and upright position in accordance with one embodiment of the invention.

In further illustration of the reading stand in accordance with aspects of the invention, FIG. 8 is a front perspective view of the base member case of a reading stand in accordance with one embodiment of the invention, i.e., with the reading lid 200 removed. In accordance with one embodiment of the invention, FIG. 8 shows that the base 100 may be provided with textured areas 106. For example, the textured areas 106 might include a depressed area that will contain embossed narrative and drawings, for example.

Figure 9:
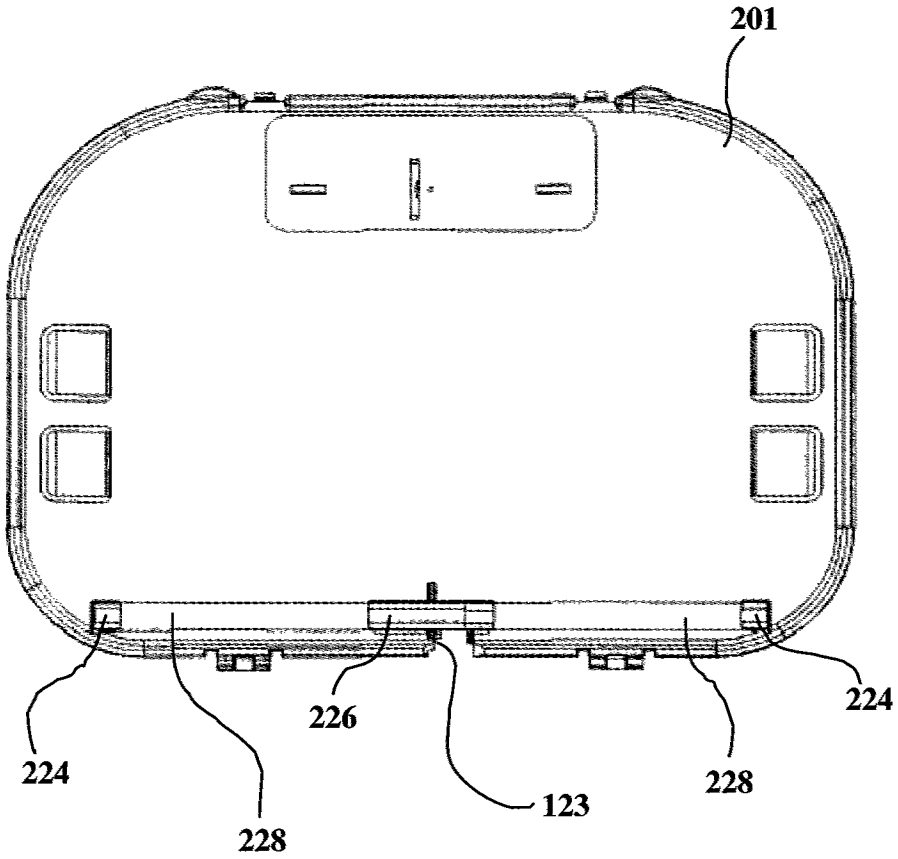
FIG. 9 is a top view of a reading lid of the reading stand for mounting on the base of FIG. 8 in accordance with one embodiment of the invention.

Further, FIG. 9 is a top view of a reading lid of the reading stand for mounting on the base of FIG. 8 in accordance with one embodiment of the invention. Also, FIG. 10 is a perspective view of the reading lid of FIG. 9, and FIG. 11 is a side view of the reading lid of FIG. 9 in accordance with one embodiment of the invention. Further, FIG. 12 is a back perspective view of a reading stand in a closed position with the base of FIG. 8 and the lid of FIG. 9 in accordance with one embodiment of the invention.

Figure 14:
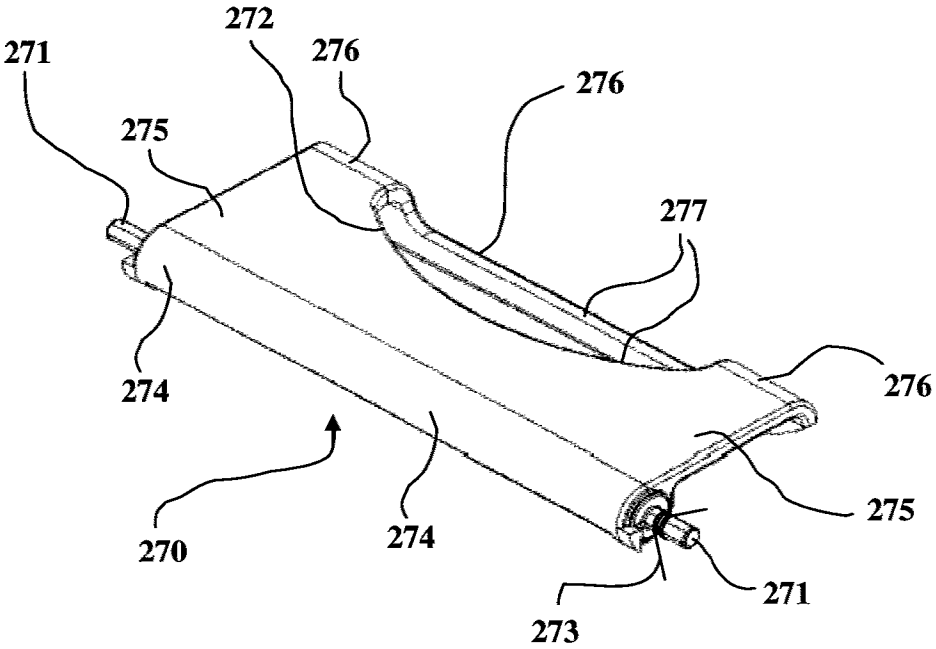
FIG. 14 is a perspective view showing further details of a page holder in accordance with one embodiment of the invention.

FIGS. 9-11 illustrate the manner in which the page holders 270 are mounted on the reading platform 201. The reading lid 200 includes multiple page holder end housings 224 to support respective page holders 270. That is, each page holder end housing 224 works in conjunction with a page holder center housing 226 so as to retain a respective page holder 270. More specifically, as shown in FIGS. 9-11, the page holder end housing 224 provides a page holder channel 225. Further, the page holder center housing 226 provides a channel 227. As shown in FIG. 14, the page holder 270 is provided with a set of page holder pins 271, in accordance with one embodiment of the invention. The page holder pins 271 are respectively disposed in the page holder channel 225 and the channel 227, i.e., so as to pivotally attach the page holder 270 to the reading platform 201. In accordance with one embodiment of the invention, a spring 273 with arms may be mounted upon each page holder pin 271 so as to engage with one of the page holder channel 225 or the channel 227 and bias the page holder 270 against the reading platform 201, i.e., so as to frictionally hold a document, for example. Accordingly, the page holder 270, including the page holder pins 271, is disposed in a slot 228 (see FIG. 9) in the reading platform 201 so as to position the page holder pins 271 within the channels (225, 227).

Relatedly, FIG. 7 shows an opposing side of the channel 227 with the page holder 270 (with pins 271 and spring 273) positioned within the channel 227. As shown in FIG. 7, after the page holder 270 (and specifically the pins 271) are positioned in the channels (225, 227), a stop piece 229 may be disposed so as to secure the pins 271 in place. For example, the stop piece 229 may simply include a small piece of material glued to the channels (225, 227).

The structure of page holder 270 will hereinafter be described in further detail. As shown in FIG. 1, FIG. 10 and FIG. 14, for example, the reading stand 10 includes a reading platform 201 and at least one page holder 270 pivotally disposed upon and connected to the reading platform, the page holder biased against the reading platform for retaining a document. With reference to FIG. 14, the page holder 270, in accordance with one embodiment of the invention, includes a holder housing portion 274 extending along a first side of the page holder 270, a center planar portion 275 extending along the holder housing portion 274, and an arcuate flange 276 extending along the center planar portion 275. An aperture 277 is defined by the arcuate flange and the center planar portion.

As shown in FIG. 14, the holder housing portion 274 is tubular in shape. Further, as shown in FIG. 1, for example, the page holder may be supported on the reading platform on respective sides of the page holder by respective housings (224, 226) formed upon the reading platform, the housings each extending from the reading platform. Also, the holder housing portion 274 of the page holder 270 may be provided so as to form a continuous surface with the housings (224, 226).

With further reference to FIG. 10, the page holder center housing 226 is provided with a center housing slot 336 in accordance with one embodiment of the invention. The center housing slot 336 allows the passage there through of a leg of the center document support 240, i.e., the leg 240' (see FIG. 7) of the center document support 240 that contacts with a book.

Figure 15:
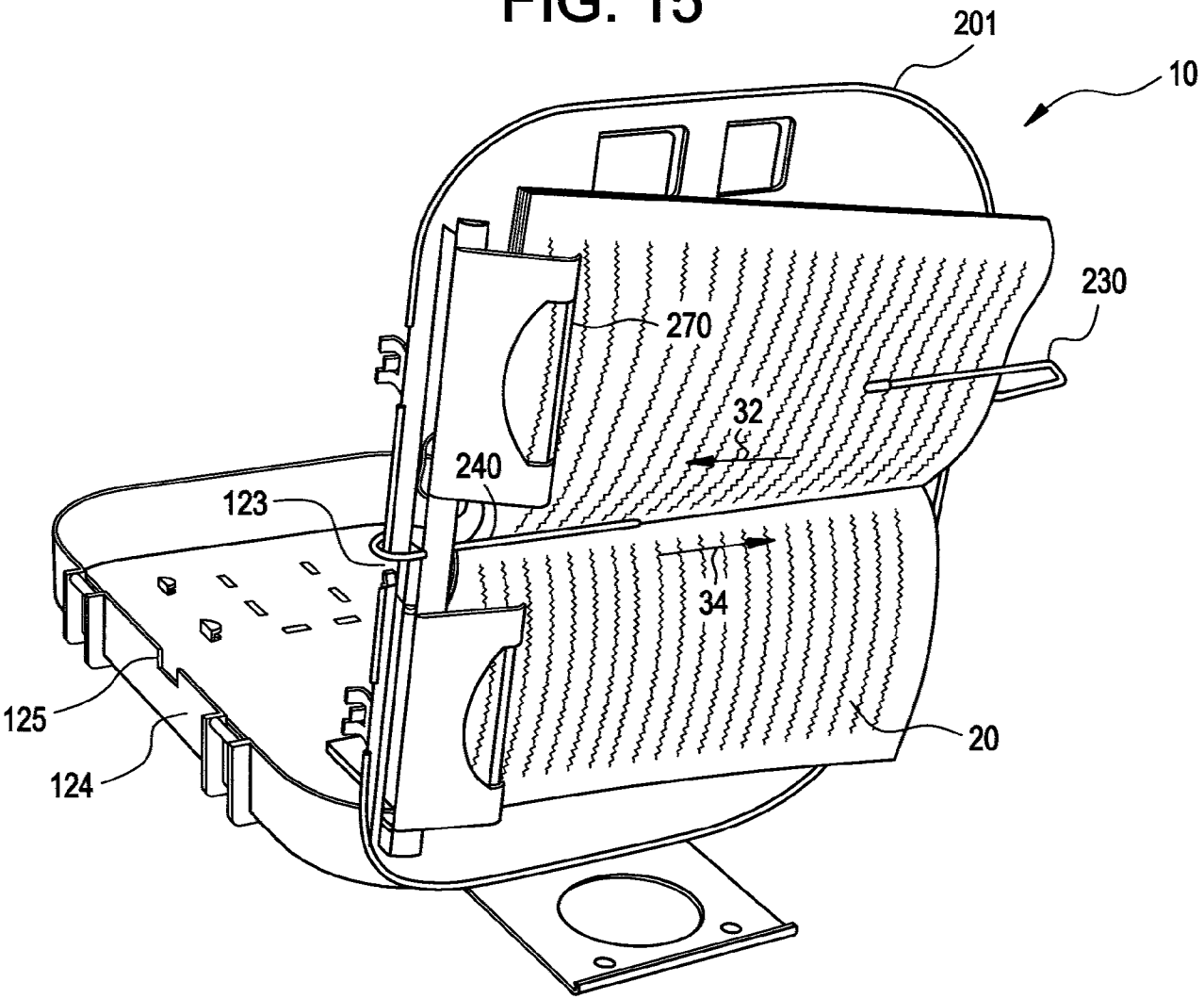
FIG. 15 is a perspective view showing a side reading arrangement in accordance with one embodiment of the invention.
Figure 16:
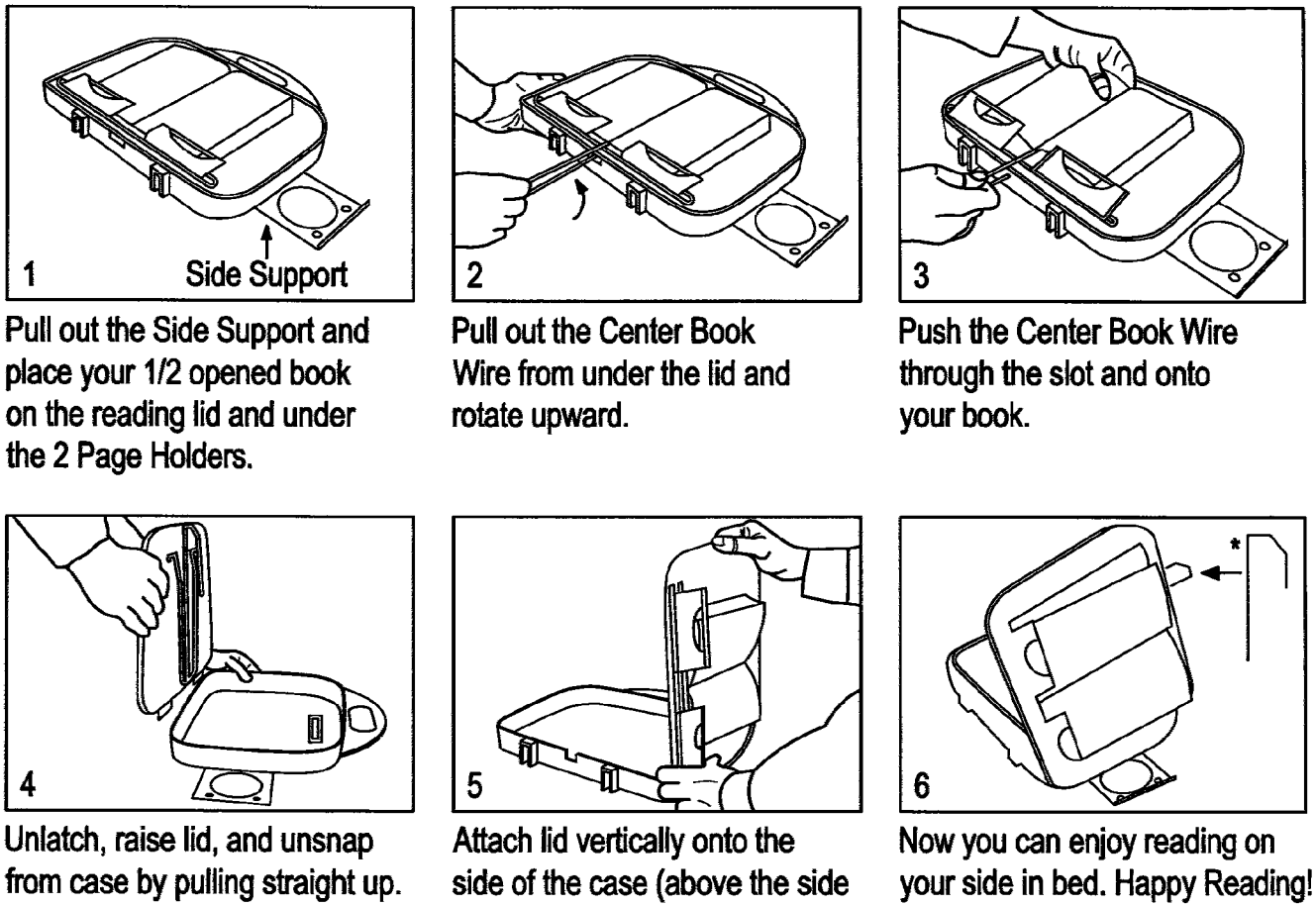
FIG. 16 is a flow chart showing preparation of a reading stand for an on-side bed reading position in accordance with one embodiment of the invention.

In further explanation of the invention, FIG. 15 is a perspective view of a reading stand 10 showing a side reading arrangement in accordance with one embodiment of the invention. Further, FIG. 16 is a flow chart showing the steps so as to arrive at the arrangement as shown in FIG. 15. The arrangement of FIG. 15 allows one to read upon their side while in bed, for example. In particular, the arrangement of FIG. 15 allows side hands-free reading in that a book 20, for example, is fully supported by the reading stand 10. It should of course be appreciated though that manipulation of the book 20 with the reader's hands would be needed to turn pages.

In particular, the book of FIG. 15 is secured upon the reading platform 201 by the various securement devices provided by the reading stand 10. The book 20 is secured using the page holders 270. Further, the center document support 240 is positioned in the center of the book 20. The center document support 240 is positioned within the center of the book 20 by extracting the center document support 240 from the reading platform 201 (as shown by arrow 32) and then sliding the center document support 240 back (as shown by the arrow 34) to the position shown in FIG. 15. This sliding is afforded by the primary collar 242 and the bracing collar 244, as shown in FIG. 4 and FIG. 7, for example.

Further, the reading platform 201 and the base back wall 124 are each provided with respective notches so as to allow the user to manipulate the center document support 240. That is, the base back wall 124 is provided with a notch 125, and the reading platform 201 is provided with a notch 123, as shown in FIG. 15.

The book 20 of FIG. 15 is further retained on the reading platform 201 by the page assist support 230, i.e., the page assist support 230 prevents the upper page of the book 20 from falling. The page assist support 230 is positioned and maintained in the position of FIG. 15 by manipulating the page assist lock 290, as shown in FIG. 4, for example, i.e., so as to lock the page assist support 230 into the position shown in FIG. 15. Also, as described herein, the side reading brace assembly 170 prevents the reading stand 10 from tipping over.

FIG. 16 is a flow chart showing preparation of a reading stand for an on-side bed reading position in accordance with one embodiment of the invention, as noted with reference to FIG. 15 above. As shown in FIG. 16, the process starts in step 1. In step 1, the user pulls out the side support 174 and places an opened book on the reading lid and under the two page holders 270. Then, in step 2, the user pulls out the center document support 240 from under the lid and rotates the center document support 240 upward. Then, the process passes to step 3.

In step 3, the user pushes the center document support 240 through the center housing slot 336, as described above with reference to FIG. 10, and continues to push the center document support 240 onto the book.

Then, in step 4, the user unlatches the latches 180, raises the reading lid 200, and unsnaps the reading lid 200 from the base 100 by pulling straight up. That is, the user disengages the hinge assembly 160 by pulling the hinge shoulder portion 266 (so as to flex the fingers that form the hinge shoulder portion 266) away from the pin 162. In short, the user unsnaps the reading lid 200 from the base 100.

Thereafter, in step 5, the user positions the reading lid 200 so as to attach the reading lid vertically onto the side of the base 100, i.e., using the side support clips 250. As shown in FIG. 16, the reading lid 200 is attached on the side with the side reading brace assembly 170. A page assist support 230 may be used to prevent falling of the pages of the book when positioned sideways. Thereafter, in step 6, the user is left to enjoy reading while laying on the user's side in bed, for example.

Figure 17:
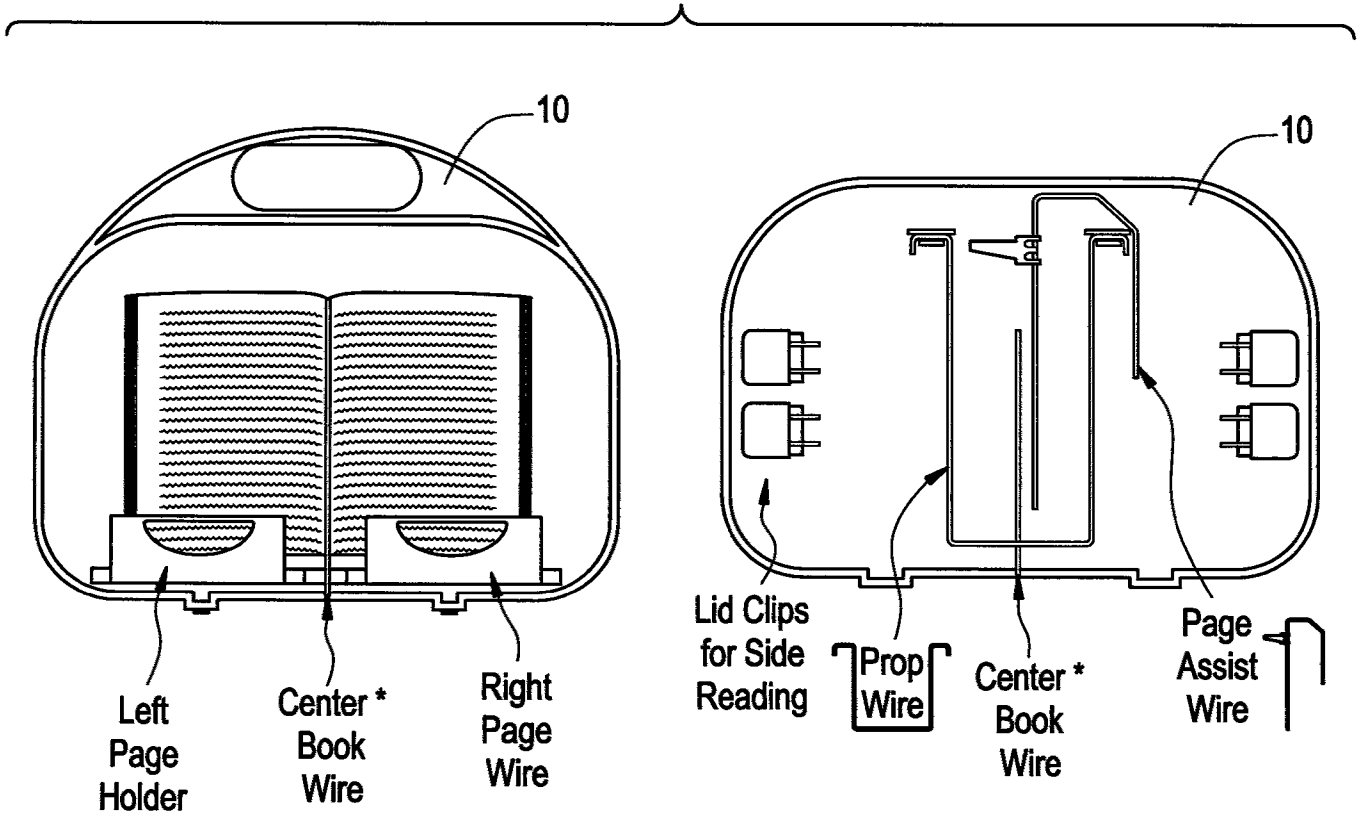
FIG. 17 is a block diagram of a reading stand in accordance with one embodiment of the invention.

FIG. 17 is a block diagram of a reading stand in accordance with one embodiment of the invention. FIG. 17 is provided to show further aspects of a lid of a reading stand 10', in accordance with one embodiment of the invention. It should be appreciated that the lid in accordance with the various embodiments of the invention described herein, might be used independently, i.e., without an associated base. As shown, the reading stand 10' includes a left page holder, as well as a right page holder. Further, the reading stand 10' includes a center book wire, which is provided to retain a book upon the reading stand 10'.

The reading stand 10' also includes lid clips for side reading and a prop wire for propping the lid as shown in FIG. 17. The reading stand 10' of FIG. 17 further includes a center book wire and a page assist wire, as described in detail above. The center book wire and the page assist wire, as referred to in FIG. 17 are typically tucked behind the reading lid and their use is optional. For example, the center book wire and the page assist wire are recommended for on-side reading, heavy books, thick paper backs, and for holding any books that are difficult to keep open, for example. Once the center book wire is inserted in the center of the book, it can remain permanently in the center of the book as the book is read from cover to cover.

In accordance with one aspect of the invention, it is appreciated that in accordance with embodiments of the invention, it is not necessary that a wire be used to retain a document, as described herein, i.e., to serve as the page assist support 230 and/or the center document support 240. Rather, other suitable structure might also be used, such as a plastic structure.

Figure 18:
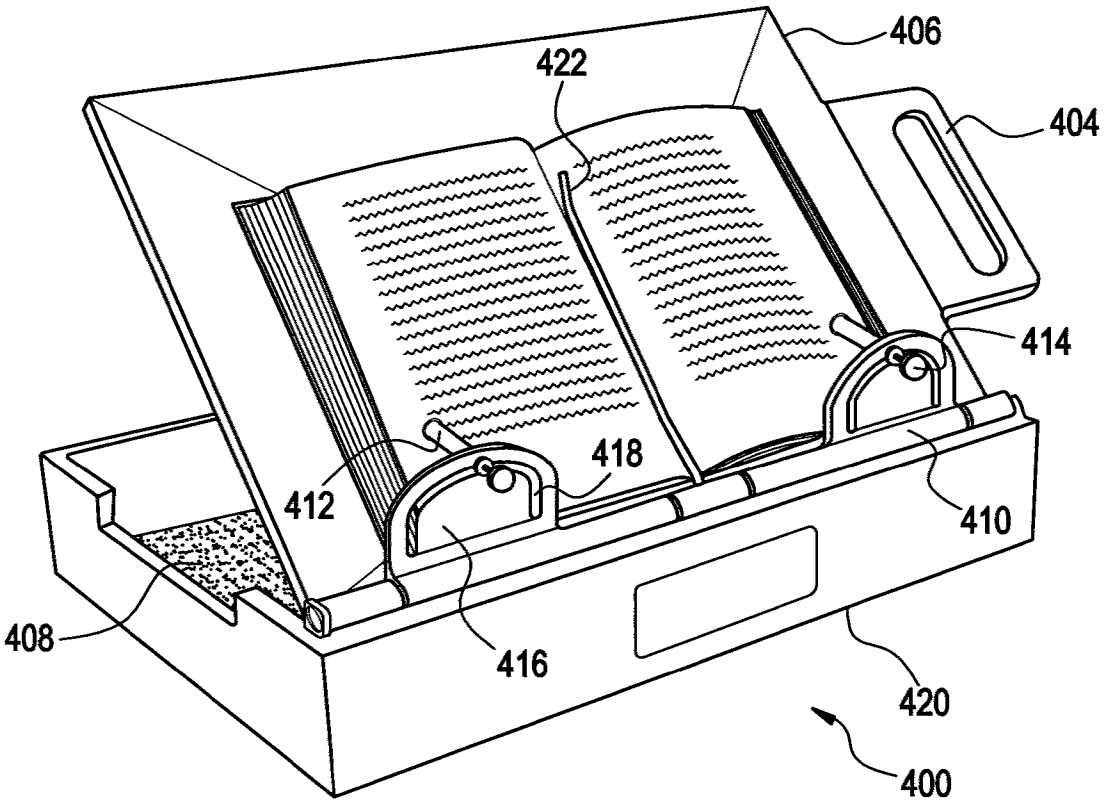
FIG. 18 is a diagram showing a reading stand supporting a book in accordance with a further embodiment of the invention.
Figure 19:
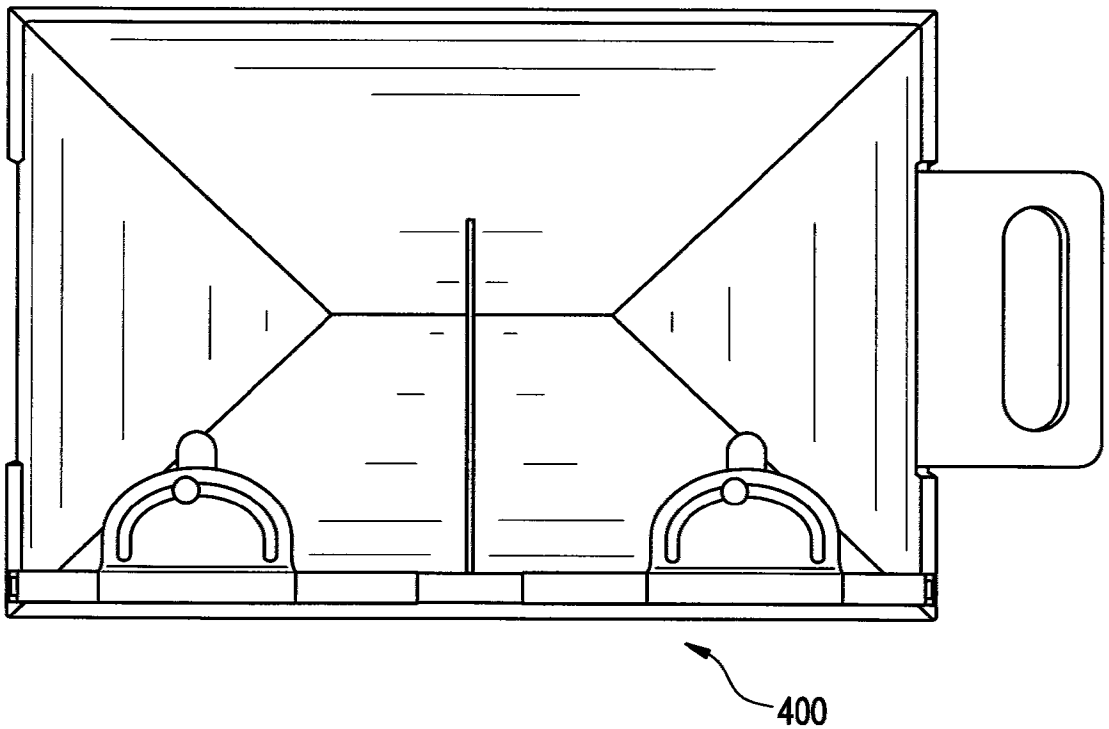
FIG. 19 is the reading stand of FIG. 18 in a different position for supporting a book in accordance with one embodiment of the invention.

FIG. 18 is a diagram showing a reading stand supporting a book in accordance with a further embodiment of the invention. FIG. 19 is the reading stand of FIG. 18 in a different position for supporting a book in accordance with one embodiment of the invention.

FIG. 18 shows a reading stand 400 in accordance with a further embodiment of the invention. As shown in FIG. 18, as well as in FIG. 19, the reading stand 400 includes a supporting portion 406 that is hinged along one side, using hinge 410, to a body portion 420. The body portion 420 may be in the form of a box with the supporting portion 406 forming the top of the box. That is, the body portion 420 might have four sides and a bottom.

Arms or other arrangements are provided to retain pages open on opposing sides of a book, for example. The arms might be in the form of rods 412 that are secured to respective plates 416. The arms might be arranged so as to be connected to the hinge 410. Further, a rod 422 is implemented, in accordance with one embodiment of the invention, to be disposed in the center of the book, for example. The rod 422 may serve to support the book upon the supporting portion 406, along with the plates 416 and the rods 412.

As shown in FIG. 1, the reading stand 400 may have a handle 404 on the right hand side for example. The handle 404 provides a support for a user to hold the reading stand. The handle 404 of course could be positioned on the left side, or alternatively, on both sides. Further, the handle 404 may be fixed and immovable relative to a supporting portion 406 of the reading stand 400, or alternatively, the handle 404 might be movable relative to the supporting portion 406. That is, the handle 404 might slide underneath the supporting portion 406 so as to be retracted in a non-use position. The travel of the handle 404 between an extended use position and a retracted non-use position may be controlled by suitable stops, as should be appreciated.

As shown in FIG. 18, the supporting portion 406 might be supported by a rod (not shown) that rests in the cavity 408 of the reading stand, i.e., the rod might rest in a slot in the back of the supporting portion 406. During non-use, the rod might simply be free in the reading stand. Alternatively, the supporting portion 406 of FIG. 1 might be adjustably supported in a desired position by other techniques, i.e., such as by friction arrangement in hinge 410.

As shown in FIG. 1, rods 412 may be used to retain pages of the book in a desired position. The rod 412 might include a threaded end 414, which may be loosened. The threaded end 414 allows the rod 412 to be loosened and adjusted relative to plate 416. That is, the rod 412 may be re-positioned within a groove 418 in the plate 416.

Figure 20:
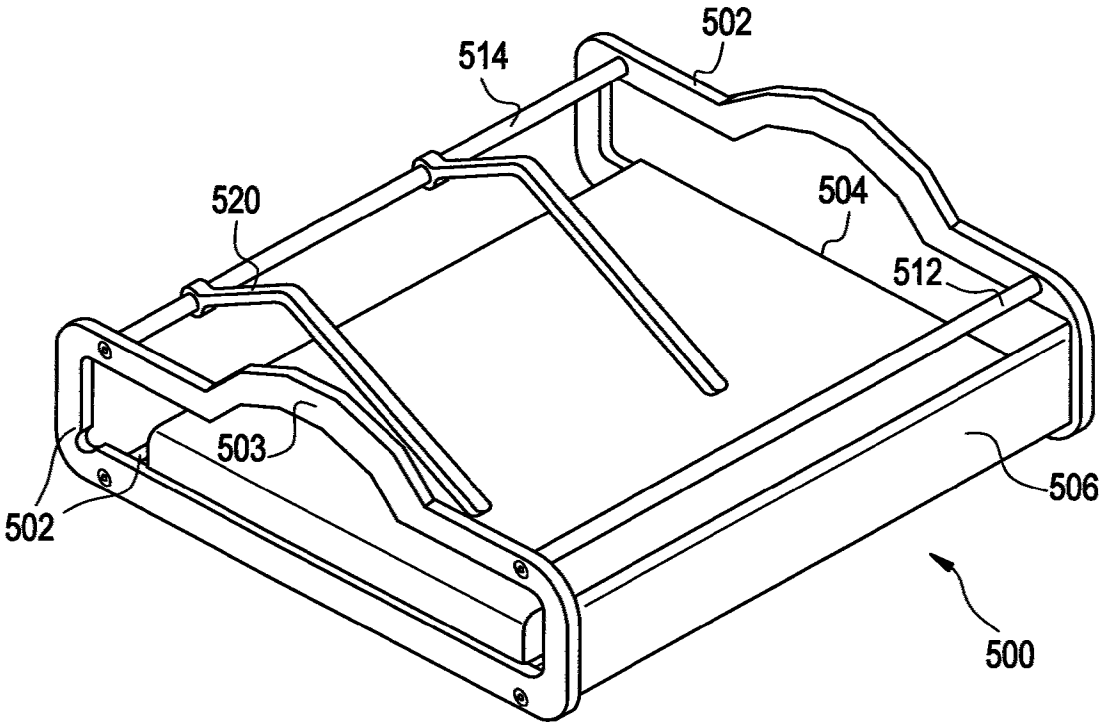
FIG. 20 is a diagram showing a reading stand supporting a book in accordance with a further embodiment of the invention.

FIG. 20 is a diagram showing a reading stand 500 in accordance with a further embodiment of the invention. The reading stand 500 of FIG. 20 includes a frame 502 upon which is supported a base cushion 504. The base cushion 504 is provided to afford a soft surface upon which to rest a book or other document, in accordance with one embodiment of the invention.

The reading stand 500 further includes bars (512, 514) extending between frame portions of the frame 502, as shown in FIG. 20. The frame 502 may be shaped to provide handles 503. Further, the reading stand 500 may be provided with arms 520, which are rotateably mounted on the bar 514. The arms 520 are movably adjustable so as to be disposed upon the page of a book, the example.

Figure 21:
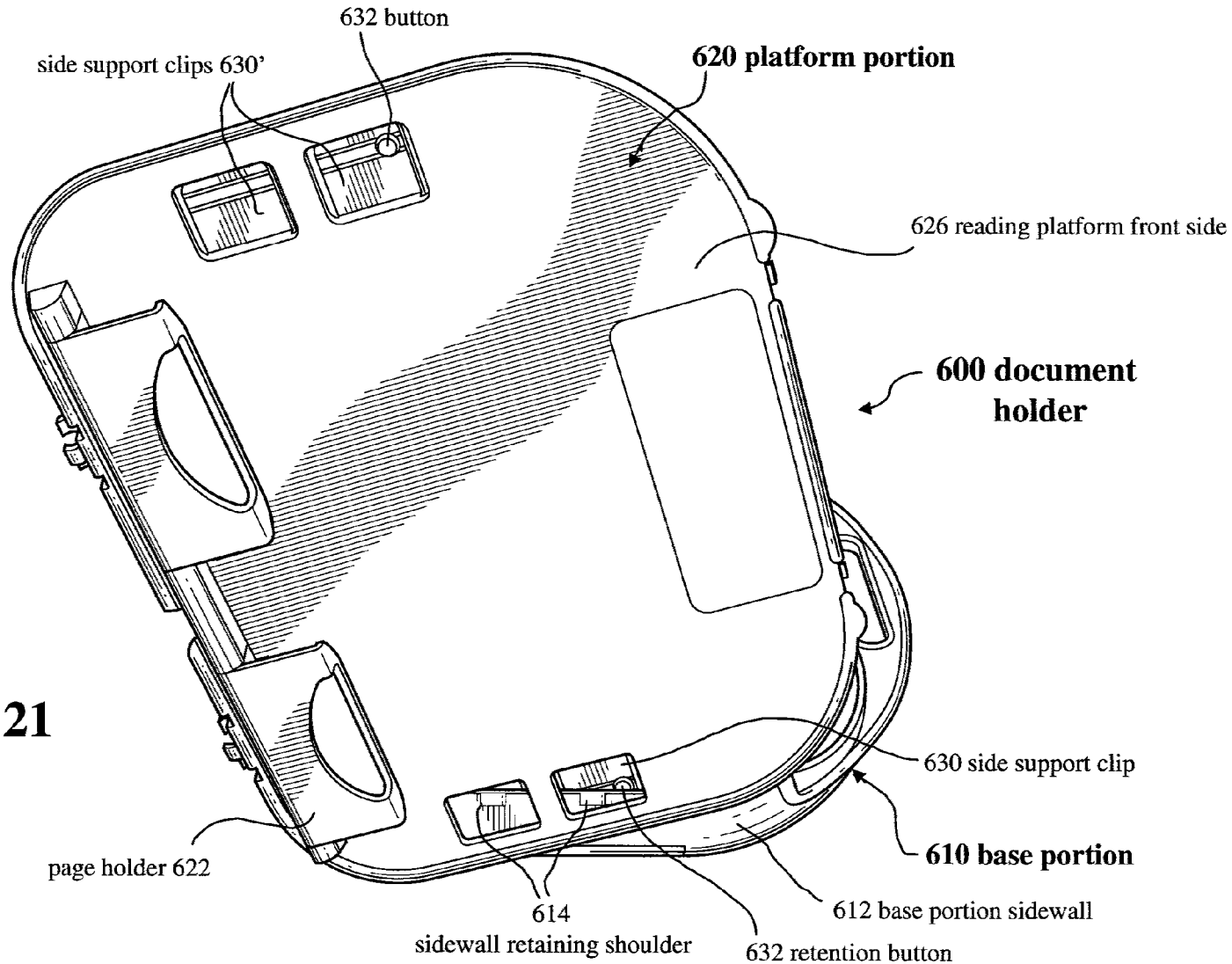
FIG. 21 is a perspective view of a further document holder with a retention button in accordance with one embodiment of the invention.

Hereinafter, aspects of further embodiments of the invention will be described. FIG. 21 is a perspective view of a document holder provided with an enhanced side reading feature in accordance with one embodiment of the invention. As described above with reference to FIG. 3. a side support clip 250 or clips afford reading a document in a side position. The side support clips 250 may be slid over a side wall of the base member case 101, so as to provide the user with an arrangement to afford reading while laying on one's side. FIG. 21 shows further features associated with use of the side support clips.

Figure 23:
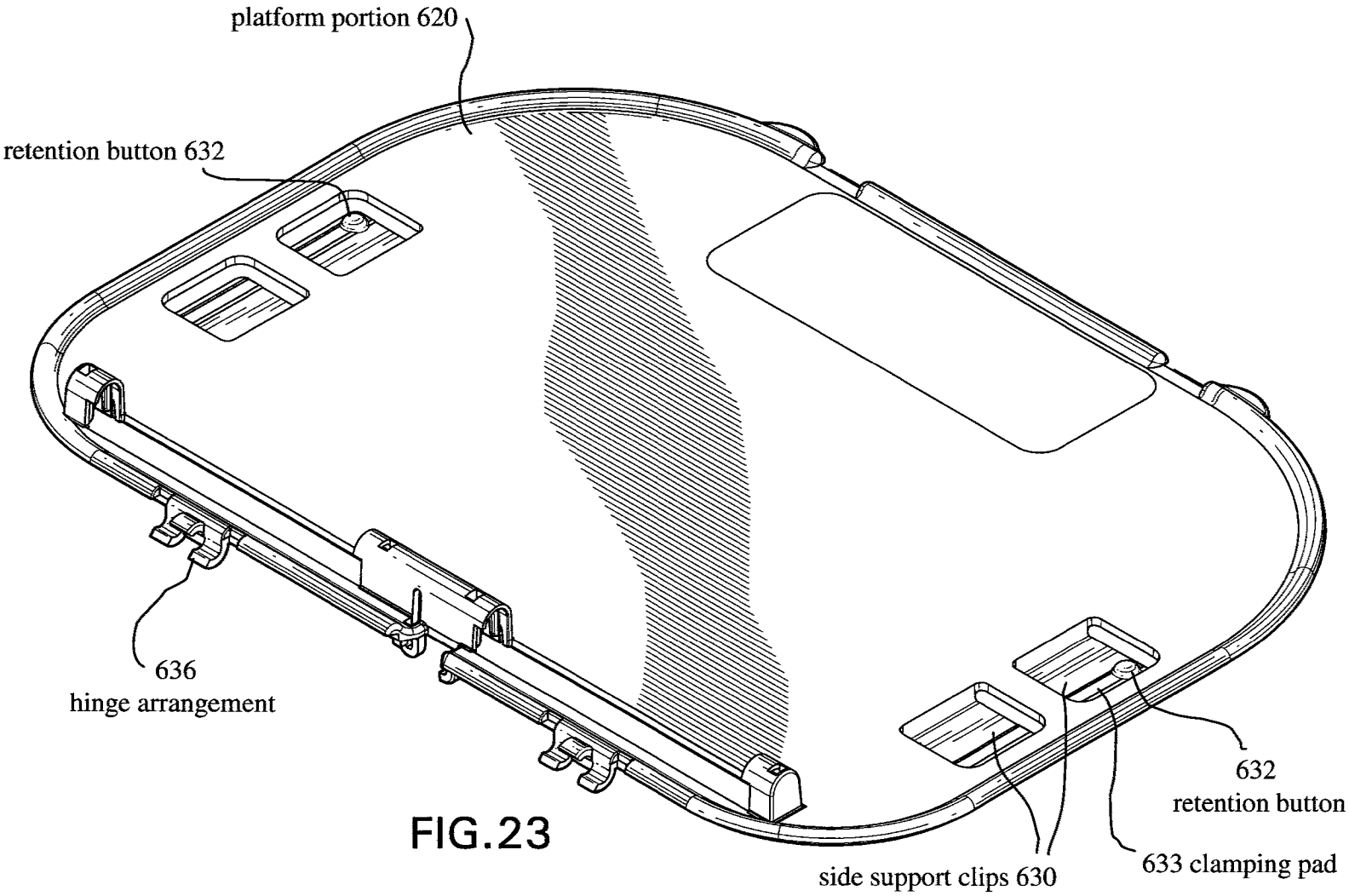
FIG. 23 is a perspective view of a platform portion with retention buttons in accordance with one embodiment of the invention.

As shown in FIG. 21, a document holder 600 includes a base portion 610 and a platform portion 620 in a similar manner as embodiments discussed above. In a manner similar to FIG. 3, the platform portion 620 includes side support clips 630. The side support clips 630 extend from the under side and in parallel with the reading platform front side 626 of the platform portion 620, as shown in FIGS. 21 and 23.

In accordance with the embodiment of FIG. 21, the side support clip 630 is provided with a retention button 632. The retention button 632 engages with the base portion 610 so as to provide a securement feature to secure the platform portion 620 on the base portion 610. The invention is not limited to the particular shape of a retention button 632, i.e., a circular knob. That is, other protuberances might be used to engage with the base portion 610. Further, in one embodiment, only some of the side support clips 630 may be provided with the retention button 632. Alternatively, all the side support clips 630 may be provided with retention button 632, as may be desired. The retention button 632, or some other protuberance, may be integrally formed with the side support clip 630 or may be mechanically attached in some manner.

Figure 22:
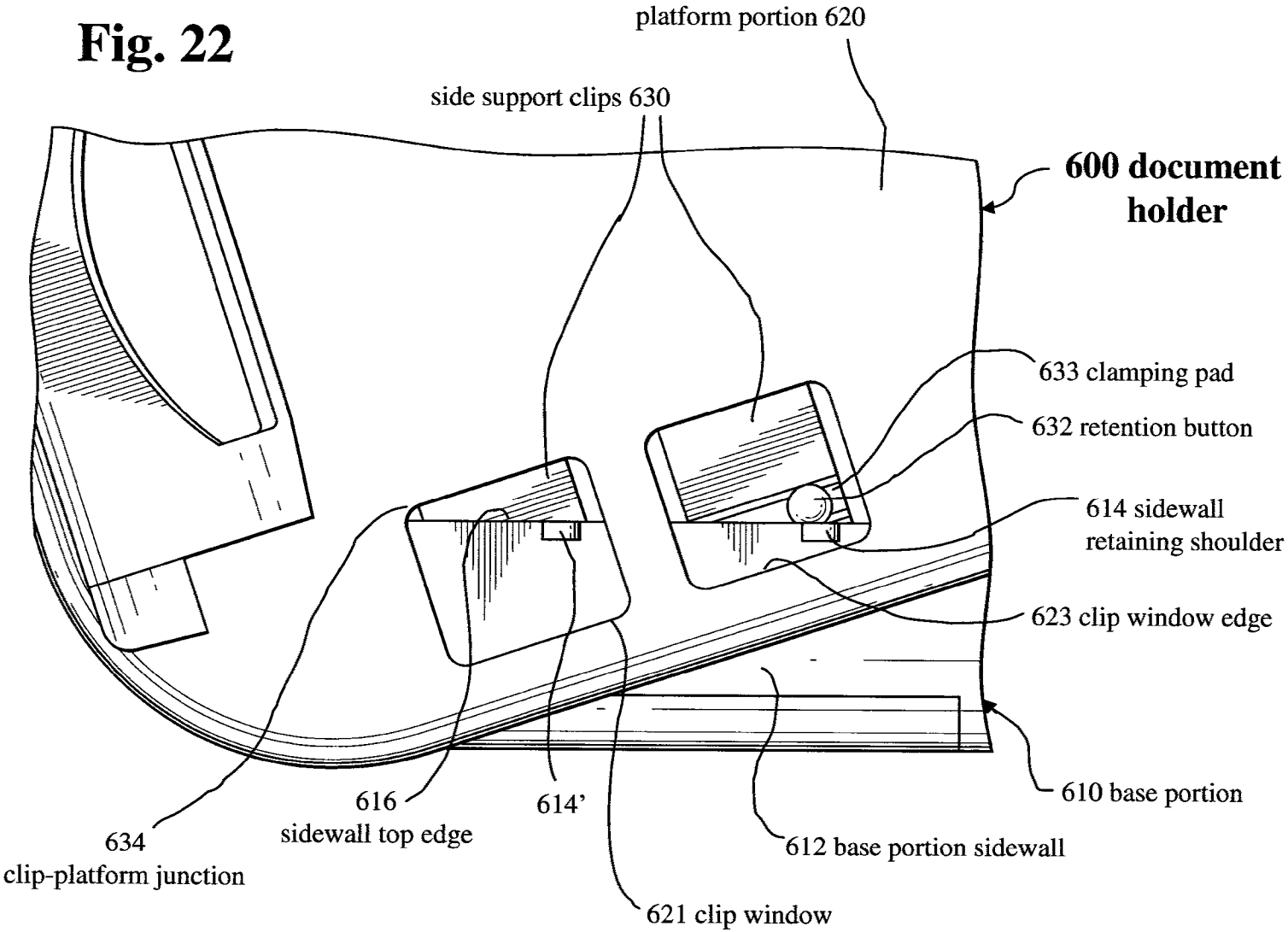
FIG. 22 is a perspective view showing further aspects of the retention buttons in accordance with one embodiment of the invention.

As shown in FIGS. 21 and 22, the base portion 610 includes a base portion sidewall 612. The base portion sidewall 612 includes a pair of sidewall retaining shoulders 614. As shown, the sidewall retaining shoulders 614 may be in the form of rectangular shaped protuberance or ledge. The sidewall retaining shoulder 614 may be disposed adjacent the sidewall top edge 616, as shown in FIG. 22.

As shown in FIG. 21, the base portion sidewall 612, along with other walls 612' (see FIG. 25) forms an enclosed volume 619. However, it is not needed that the base portion sidewall 612 be a part of any such wall arrangement. Rather, the base portion sidewall 612 may simply be a single wall or planer vertical member that may interface with the platform portion 620 and the side support clip 630, as described herein. It is of course noted that the base portion sidewall 612 requires some type of support structure (i.e., some type of support portion) so as to support the weight of the platform portion 620, as well as the particular document being supported on the platform portion 620. Accordingly, the base portion sidewall 612 might be rigidly secured to a support surface, for example.

In set up of the arrangement shown in FIG. 21, the user first removes the platform portion 620 from the base portion 610, as described above. The user then positions the platform portion 620 on its side and above the sidewall retaining shoulder 614. The user then drops the platform portion 620 such that the base portion sidewall 612 is sandwiched between the platform portion 620 and one or more of the side support clips 630. In this positioning, the sidewall retaining shoulder 614 will be disposed in the clip window 621. Further, the retention button 632 engages with the base portion sidewall 612.

As shown in FIG. 22, the side support clip 630 is typically attached to the platform portion 620. For example, the side support clip 630 may be integrally formed with the platform portion 620, for example, in a molding process. Further, the side support clip 630 is typically constructed of some flexible material. Such flexibility of the side support clip 630 allows the side support clip 630 to flex as the platform portion 620 is being disposed on the base portion 610, as shown in FIG. 21.

The arrangement shown in FIG. 22 provides a secure and adjustable side reading unit. The platform portion 620 may be readily tilted vis-à-vis the base portion 610. The sidewall retaining shoulder 614 may simply be disposed in the clip window 621, i.e., and take no active role in the assembly. Alternatively, the sidewall retaining shoulder 614 may be disposed against the clip window edge 623, i.e., so as to prevent the platform portion 620 from being dislodged from its position on the base portion 610.

Figure 26:
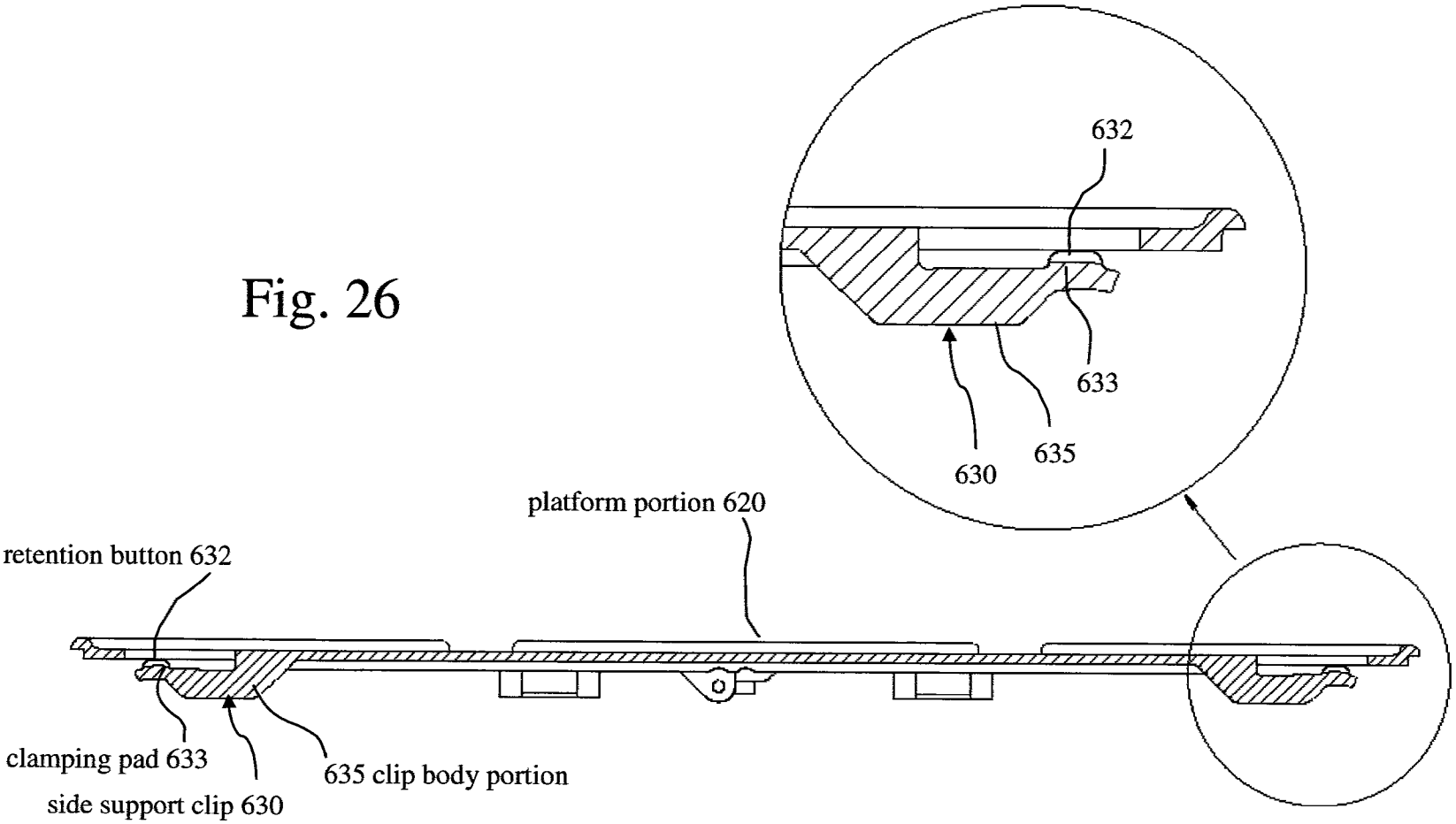
FIG. 26 is a cross-sectional view along line 26-26 of FIG. 24 in accordance with one embodiment of the invention.

FIG. 22 also shows the feature of a clamping pad 633. The clamping pad 633 is a raised portion on the side support clip 630 that may be used to secure a good fit between the platform portion 620 and the base portion 610. The clamping pad 633 may be used to transfer the holding power of the side support clip 630 to the end of the side support clip 630. Accordingly, in one embodiment, the clamping pad 633 may provide the functionality of providing a holding force between the platform portion 620 and the base portion 610 and the retention button 632 provides a stop. The clamping pad 633 is also shown in FIG. 26. It is appreciated that the particular dimensions of the clamping pad 633 may of course be varied as desired. It is of course further appreciated that the dimensions of the various other components of the document holder, as described herein, may also be varied. In particular, the position and the size of the retention button 632 may be varied as desired.

The retention button 632 may also play an active role in the arrangement and interrelationship between the base portion 610 and the platform portion 620. As shown in FIG. 22, the retention button 632 may rest against the sidewall top edge 616. Further, in a supported position, the base portion sidewall 612 may be engaged with the clip-platform junction 634, as shown in FIG. 22. That is, the base portion sidewall 612 may be lodged between the platform portion 620 and the side support clip 630. In such position, clip-platform junction 634 rests on the base portion sidewall 612 so as to support the platform portion 620.

FIG. 23 is a perspective view of a platform portion with retention buttons in accordance with an embodiment of the invention. As shown, the document holder 600, provided with the retention buttons 632, may include the various features described above. In particular, the document holder 600 may include page holders 622 and a hinge arrangement 636.

Figure 24:
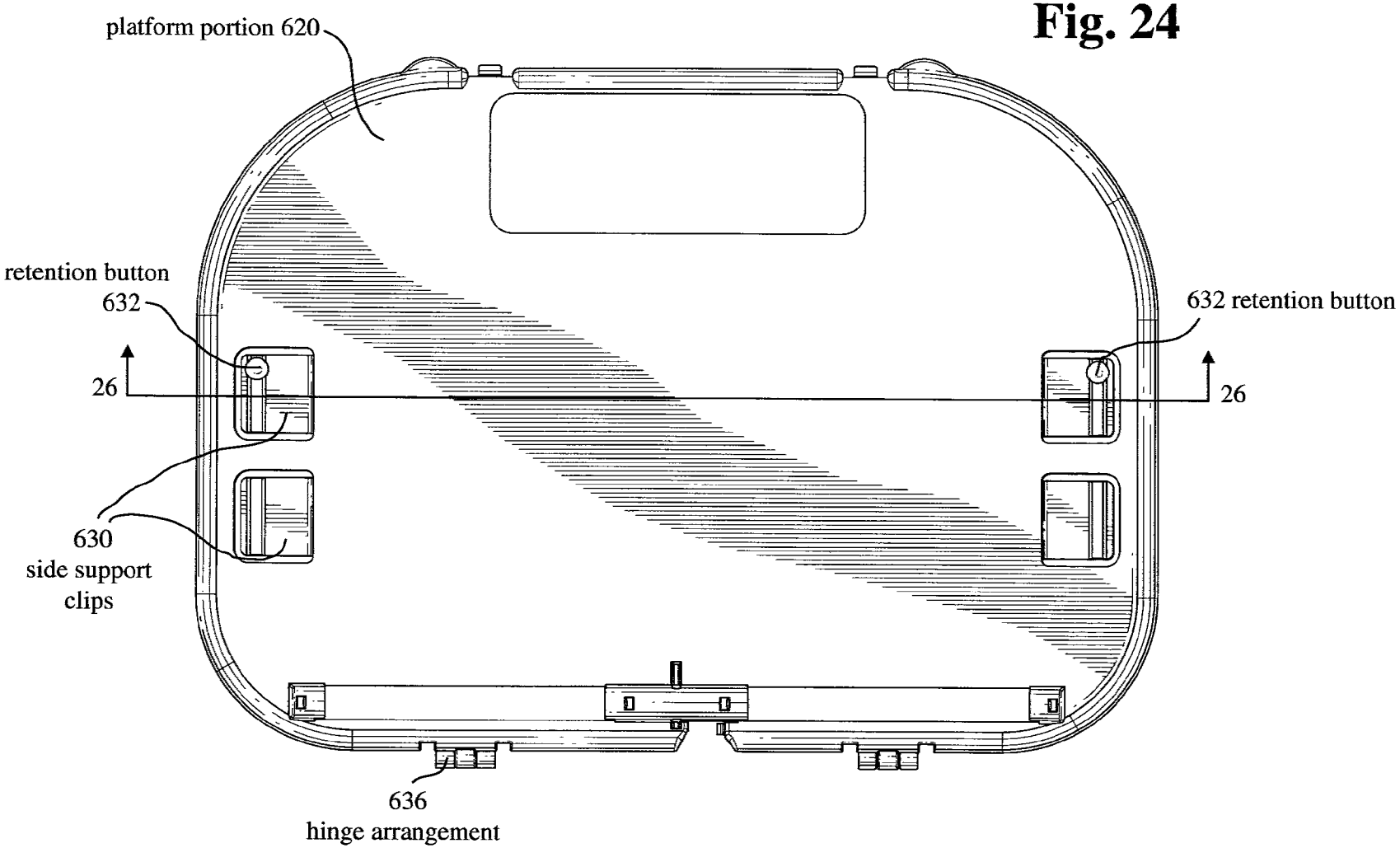
FIG. 24 is a top view of a platform portion with retention buttons in accordance with one embodiment of the invention.

FIG. 24 is a top view of a platform portion with retention buttons in accordance with one embodiment of the invention. FIG. 24 further shows the hinge arrangement 636. The hinge arrangement 636 provides for the platform portion 620 to be connected to the base portion 610, i.e., when the platform portion 620 is not disposed on the base portion 610 (in the side reading position).

Figure 25:
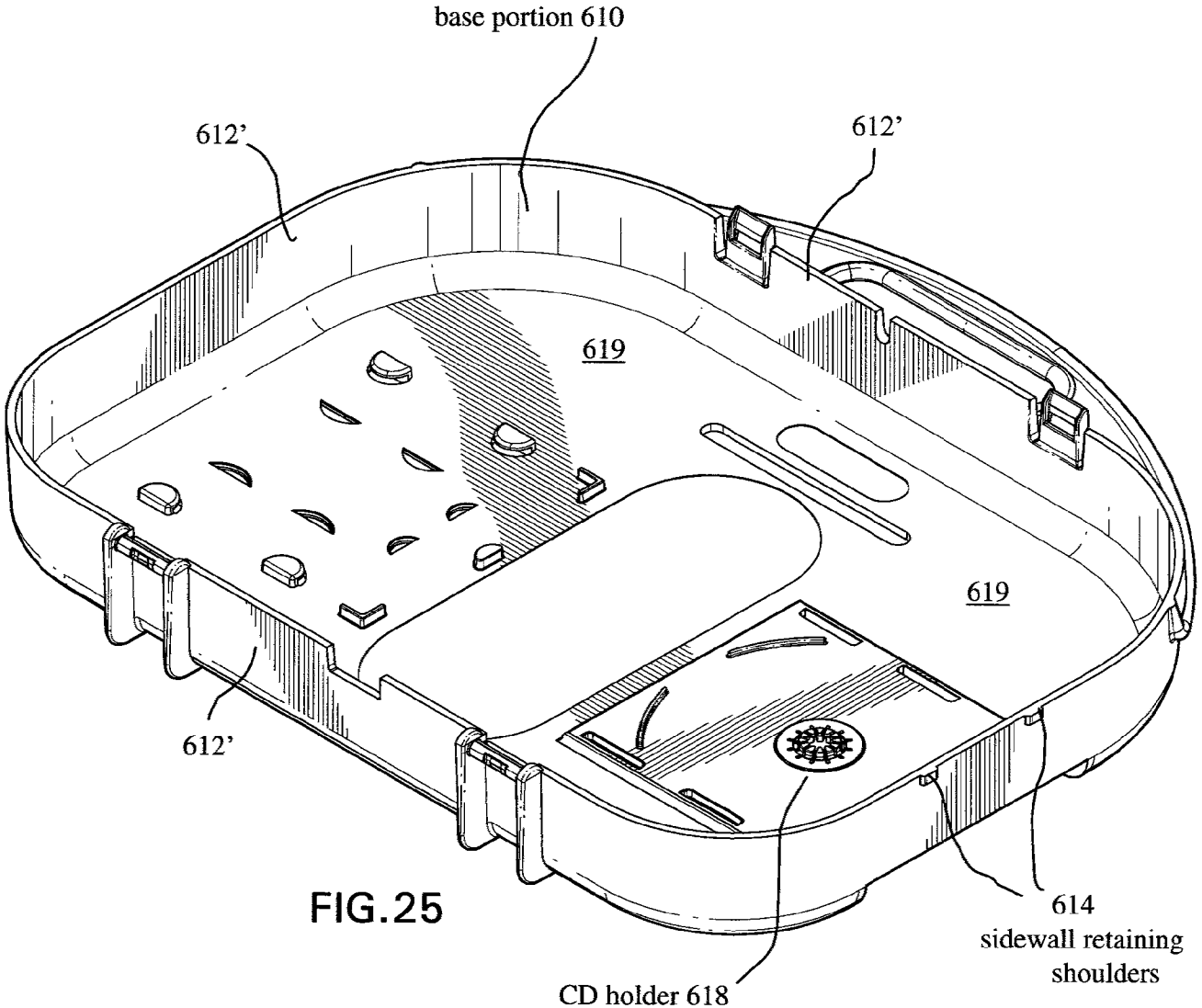
FIG. 25 is a perspective view of a base portion showing sidewall retaining shoulders in accordance with one embodiment of the invention.

In further illustration of the document holder 600 with retention buttons, FIG. 25 is a perspective view of the base portion 610 showing the sidewall retaining shoulders 614 in accordance with one embodiment of the invention. As shown in FIG. 25, there are two sidewall retaining shoulders 614 on each side of the base portion 610. However, it is appreciated that any number of sidewall retaining shoulder 614 might be utilized, including in particular one or three sidewall retaining shoulders 614. However, engagement between the base portion 610 and the side support clip 630 may be enhanced if the sidewall retaining shoulders 614 are disposed in the clip window 621, i.e., as shown in FIG. 22. Such arrangement will provide for a lower surface of the platform portion 620 fitting flush against the base portion sidewall 612.

The arrangement of the base portion 610 (with the surrounding sidewalls) and the platform portion 620 provides for a convenient carrying case. That is, in the closed position (with the platform portion 620 disposed on the base portion 610) a secure compartment is formed that may be used to secure documents and/or other materials while the document holder 600 is being transported from one location to another.

In further illustration of the invention, FIG. 26 is a cross-sectional view along line 26-26 of FIG. 24 in accordance with one embodiment of the invention. FIG. 26 shows details of the platform portion 620, including the side support clip 630, the clamping pad 633 and the retention button 632. As shown in FIG. 26, the retention button 632 slightly crosses the plane formed by the lower surface of the platform portion 620. The relative dimensions of such components may be varied based on the elastic properties of the materials from which the components are constructed, as well as the holding strength required. FIG. 26 also shows that the side support clip 630 may include a component characterized as a clip body portion 635. The clamping pad 633 is disposed on the clip body portion 635, and in turn the retention button 632 is disposed on the clamping pad 633. The clip body portion 635, the clamping pad 633 and the retention button 632 collectively form the side support clip 630, as shown in FIG. 26. Further, the clip body portion 635, the clamping pad 633 and the retention button 632 may be integrally formed with the platform portion 620.

Accordingly, the above described arrangement utilizing the retention buttons 632 provides a versatile and easily manipulated platform by which to position and support a book for reading on one's side. In particular, the retention button 632 engaging with the sidewall top edge 616 and/or the sidewall retaining shoulder 614 engaging with the clip window edge 623 offer support for a document in a wide variety of positions.

As described herein, the devices above, in accordance with the various embodiments of the invention, have been described as a reading stand and described in the context of holding a book. However, it is appreciated that the devices of the invention may be used to hold a wide variety of materials for viewing, as may be desired. Accordingly, the devices of the invention might hold books, magazines, papers, photographs or any other object that might be physically supported on the device. Further, the term "book" as used herein is understood to mean any document with connected pages or portions, for example.

The devices of the invention, in accordance with the various embodiments, may be made from any of a wide variety of materials, as is desired. For example, one embodiment of the invention may be made of aluminum and wood with a foam rubber cushion that accommodate books of varying thickness. The invention might be made of wood, plastic or metal, for example, or any other material. Further, a variety of production techniques may be used to make the reading stand as described herein. For example, suitable molding techniques might be utilized. Also, the various components of the reading stand may be integrally formed, as may be desired, in particular when using molding construction techniques. Also, as shown in FIGS. 1, 18 and 20, for example, the respective arrangements may be adjusted to accommodate books of varying sizes. Further, the respective arrangements may be provided in various sizes, as desired. Also, it is appreciated that the various features described herein may be variously combined with each other so as to provide a desired product.

In conclusion, it will be readily understood by those persons skilled in the art that the present invention is susceptible to broad utility and application. Many embodiments and adaptations of the present invention other than those herein described, as well as many variations, modifications and equivalent arrangements, will be apparent from or reasonably suggested by the present invention and foregoing description thereof, without departing from the substance or scope of the invention.

Accordingly, while the present invention has been described here in detail in relation to its exemplary embodiments, it is to be understood that this disclosure is only illustrative and exemplary of the present invention and is made to provide an enabling disclosure of the invention. Accordingly, the foregoing disclosure is not intended to be construed or to limit the present invention or otherwise to exclude any other such embodiments, adaptations, variations, modifications and equivalent arrangements.

What is claimed is:

1. A reading stand for supporting a document, the reading stand comprising:

a base portion including at least one base portion sidewall, the at least one base portion sidewall being supported by the base portion, the at least one base portion sidewall including a single base portion sidewall;

a platform portion forming a support surface to support the document, the platform portion including a page holder to retain the document, the page holder being pivotally attached to the platform portion; and a side support clip extending from the platform portion such that the single base portion sidewall is receivable between the platform portion and the side support clip in an assembled position, the side support clip having a protuberance disposed thereon, the protuberance engageable with the single base portion sidewall; and the assembled position affords side reading;

the single base portion sidewall includes a sidewall retaining shoulder; and the platform portion includes a clip window, the sidewall retaining shoulder disposed in the clip window in the assembled position; and in such assembled position, the contact of the platform portion with the base portion comprises of the platform portion being in contact with the single base portion sidewall, such that the platform portion is supported by and retained by said contact with the single base portion sidewall; and the clip window including a clip window edge, the clip window edge engageable with the sidewall retaining shoulder in the assembled position; and the clip window forms an aperture disposed in a geometrical plane, wherein the protuberance is disposed in the aperture formed by the clip window and the protuberance passes into the plane.

2. The reading stand of claim 1, wherein the protuberance is positionable adjacent the sidewall retaining shoulder in the assembled position.

3. The reading stand of claim 1, wherein the side support clip is positioned collinearly with the clip window.

4. The reading stand of claim 1, wherein:

the base portion includes two sidewall retaining shoulders on a respective side of the base portion, and the platform portion being provided with two side support clips on a respective side of the platform portion, at least one of the provided side clips being provided with the protuberance.

5. The reading stand of claim 4, wherein the sidewall retaining shoulders are positioned adjacent a sidewall top edge of the single base portion sidewall.

6. The reading stand of claim 1, wherein the base portion further includes a plurality of walls, the plurality of walls, along with the single base portion sidewall, forming an enclosed volume.

7. The reading stand of claim 1, wherein the base portion further includes a CD holder.

8. The reading stand of claim 1, wherein the base portion and the platform portion collectively include a hinge assembly, the base portion being hingedly connectable to the platform portion when not in the assembled position.

9. The reading stand of claim 1, wherein the platform portion is integrally formed with the side support clip.

10. The reading stand of claim 1, wherein the protuberance is in the form of a button integrally formed with the side support clip.

11. A reading stand for supporting a document, the reading stand comprising:

a base portion including at least one base portion sidewall, the at least one base portion sidewall being supported by the base portion, the at least one base portion sidewall including a single base portion sidewall, the single base portion sidewall including a sidewall retaining shoulder;

a platform portion forming a support surface to support the document, the platform portion including a page holder to retain the document, the page holder being pivotally attached to the platform portion; and a side support clip extending from the platform portion such that the single base portion sidewall is receivable between the platform portion and the side support clip in an assembled position;

the sidewall retaining shoulder engaged with the platform portion in the assembled position, the assembled position affording side reading; and wherein the platform portion includes a clip window in which the side support clip is disposed, the sidewall retaining shoulder disposed in the clip window in the assembled position; and in such assembled position, the contact of the platform portion with the base portion comprises of the platform portion being in contact with the single base portion sidewall, such that the platform portion is supported by and retained by said contact with the single base portion sidewall; and the clip window includes a clip window edge, the clip window edge engageable with the sidewall retaining shoulder in the assembled position; and the clip window forms an aperture disposed in a geometrical plane, wherein a protuberance is disposed in the aperture formed by the clip window and the protuberance passes into the plane, the protuberance being attached to the side support clip.

12. The reading stand of claim 11, wherein the protuberance is in the form of a button.

13. The reading stand of claim 11, wherein the side support clip is comprised of a clip body portion, and a clamping pad disposed on the clip body portion.

14. The reading stand of claim 13, wherein a protuberance is disposed on the clamping pad.

15. A reading stand for supporting a document, the reading stand comprising:

a base portion including at least one base portion sidewall, the at least one base portion sidewall being supported by the base portion, the at least one base portion sidewall including a single base portion sidewall, the single base portion sidewall including a sidewall retaining shoulder;

a platform portion forming a support surface to support the document, the platform portion including a page holder to retain the document, the page holder being attached to the platform portion; and a side support clip extending from the platform portion such that the single base portion sidewall is receivable between the platform portion and the side support clip in an assembled position;

the sidewall retaining shoulder engaged with the platform portion in the assembled position, the assembled position affording side reading; and wherein the platform portion includes a clip window which is adjacent the side support clip, the sidewall retaining shoulder of the single base portion sidewall disposed in the clip window in the assembled position, and the clip window constituted by an opening in the support surface; and in such assembled position, the contact of the platform portion with the base portion comprises of the platform portion being in contact with the single base portion sidewall, such that the platform portion is supported by and retained by said contact with the single base portion sidewall; and the clip window includes a clip window edge, the clip window edge engageable with the sidewall retaining shoulder in the assembled position.

16. The reading stand of claim 15, the sidewall retaining shoulder constituted by a protuberance.

17. The reading stand of claim 16, the sidewall retaining shoulder constituted by the protuberance in the shape of a rectangle.

18. The reading stand of claim 15, the page holder being pivotally attached to the platform portion.

19. The reading stand of claim 15, the clip window forms an aperture disposed in a geometrical plane, and a protuberance being attached to the side support clip.

20. The reading stand of claim 19, the protuberance disposed in the aperture formed by the clip window.

21. The reading stand of claim 20, the protuberance is in the form of a button.

22. The reading stand of claim 19, the protuberance is disposed in the aperture formed by the clip window such that the protuberance passes into the plane.

* * * * *